US008970123B2

(12) United States Patent
Kanamori et al.

(10) Patent No.: US 8,970,123 B2
(45) Date of Patent: Mar. 3, 2015

(54) LED DRIVE CIRCUIT AND LED ILLUMINATION LIGHT

(75) Inventors: Atsushi Kanamori, Osaka (JP); Hirohisa Warita, Osaka (JP); Takayuki Shimizu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 180 days.

(21) Appl. No.: 13/456,791

(22) Filed: Apr. 26, 2012

(65) Prior Publication Data

US 2012/0274230 A1 Nov. 1, 2012

(30) Foreign Application Priority Data

Apr. 27, 2011 (JP) ..... 2011-099534

(51) Int. Cl.
*H05B 37/02* (2006.01)
*H05B 33/08* (2006.01)

(52) U.S. Cl.
CPC ..... *H05B 33/0815* (2013.01)
USPC ..... 315/250; 315/291

(58) Field of Classification Search
None
See application file for complete search history.

(56) References Cited

U.S. PATENT DOCUMENTS

| | | | | |
|---|---|---|---|---|
| 8,143,805 | B2 * | 3/2012 | Peng | 315/291 |
| 2007/0267984 | A1 * | 11/2007 | Peng | 315/312 |
| 2010/0237790 | A1 * | 9/2010 | Peng | 315/210 |
| 2011/0043121 | A1 | 2/2011 | Matsuda et al. | |
| 2011/0156612 | A1 * | 6/2011 | Kanamori et al. | 315/291 |

FOREIGN PATENT DOCUMENTS

| | | | |
|---|---|---|---|
| CN | 101998734 | A | 3/2011 |
| EP | 2 288 237 | A1 | 2/2011 |
| EP | 2 302 980 | A2 | 3/2011 |
| JP | 2005-26142 | A | 1/2005 |
| JP | 2006-319172 | A | 11/2006 |
| JP | 2011-134672 | A | 7/2011 |

* cited by examiner

*Primary Examiner* — Crystal L Hammond
(74) *Attorney, Agent, or Firm* — Birch, Stewart, Kolasch & Birch, LLP

(57) ABSTRACT

An LED drive circuit that is connectable to an a.c. power supply via a phase control type light adjuster and drives an LED load, including a discharge portion that consumes energy of a resonance phenomenon generated by a light adjuster capacitance component of the phase control type light adjuster and a light adjuster inductance component of the phase control type light adjuster when a current holding portion of the phase control type light adjuster is turned on.

19 Claims, 26 Drawing Sheets

LED DRIVE CIRCUIT AND LED ILLUMINATION LIGHT

This application is based on Japanese Patent Application No. 2011-099534 filed on Apr. 27, 2011, the contents of which are hereby incorporated by reference.

BACKGROUND OF THE INVENTION

1. Field of the Invention

The present invention relates to an LED drive circuit and an LED illumination light.

2. Description of the Related Art

An LED (Light Emitting Diode) features of low power consumption, long life and the like, and is finding its wide applications in not only display apparatuses but also in illumination lights and the like. Here, in an illumination light, to obtain a desired illuminance, there are many cases where a plurality of LEDs are used (e.g., JP-A-2006-319172).

A general illumination light often uses a commercial 100 VAC power supply, and considering a case where an LED illumination light is used instead of a general illumination light such as an incandescent lamp and the like, it is desirable that like a general illumination light, an LED illumination light also is structured to use a commercial 100 VAC power supply.

Here, in a case of performing light adjustment control of an incandescent lamp, a phase control type light adjuster (generally, called an incandescent lamp controller) is used (e.g., JP-A-2005-26142), which is capable of easily performing light adjustment control of electricity supply to the incandescent lamp by means of a volume device only by turning on a switching device (generally, a thyristor device, a TRIAC) at a phase angle of an a.c. power supply voltage. Also in a case of performing light adjustment of an incandescent lamp by means of a phase control type light adjuster, it is known that when the light adjuster is connected with an incandescent lamp that has a small wattage, flickering and blinking occur and normal light adjustment is impossible.

In a case of performing light adjustment control of an LED illumination light that uses an a.c. power supply, like in the case of performing light adjustment control of an incandescent lamp, it is desired to use a phase control type light adjuster. Here, FIG. 15 and FIG. 16 show conventional examples of LED illumination systems capable of performing light adjustment control of an LED illumination light that uses an a.c. power supply.

A conventional LED illumination system shown in FIG. 15 has: a phase control type light adjuster 200; an LED drive circuit 300; and an LED load 400 that includes a plurality of LEDs. The LED drive circuit 300 includes a full-wave rectifier 1 and a current limiting portion 2. Between an a.c. power supply 100 and the current limiting portion 2, the phase control type light adjuster 200 is connected in series. When a knob (not shown) of a semi-fixed resistor Rvar is set to a position, the phase control type light adjuster 200 turns on a TRIAC Tri at a power supply phase angle that corresponds to the set position. Further, in the phase control type light adjuster 200, a noise prevention circuit including a capacitor CLC and an inductance coil LLC is composed to reduce terminal noise that is fed back from the phase control type light adjuster 200 to a power supply line.

Besides, a conventional LED illumination system shown in FIG. 16 has: the phase control type light adjuster 200; an LED drive circuit 500; and the LED load 400. The LED drive circuit 500 has the full-wave rectifier 1 and a current control portion 3. The current control portion 3 has: a switching device SW1; a coil L2; a diode D1; a capacitor C4; a current detection resistor R2; and a switching control circuit 4. The switching control circuit 4 detects an effective value of an output voltage V2 from the full-wave rectifier 1 and a value of a current flowing in the current detection resistor R2 that is connected with a source of the switching device SW1; controls on/off of the switching device SW1; the and controls a current flowing in the switching SW1 to be a constant current. In accordance with a phase angle controlled by the phase control type light adjuster 200, it is possible to change a magnitude of a current flowing in the LED load 400 and becomes possible to perform light adjustment of the LED load 400.

Besides, FIG. 17 shows a conventional incandescent lamp illumination system that performs light adjustment of an incandescent lamp 5 by means of the phase control type light adjuster 200. Besides, FIG. 18 shows voltage and current waveforms at some portions of the conventional incandescent lamp illumination system shown in FIG. 17. The TRIAC Tri is turned on, whereby a voltage V3 across both ends of the incandescent lamp 5 rises and a current I1 begins to flow in the incandescent lamp. And, the on state of the TRIAC Tri is kept until the a.c. power supply voltage V1 comes close to 0 V and the current flowing in the TRIAC Tri becomes equal to or smaller than a holding current.

When the TRIAC Tri in the phase control type light adjuster 200 is turned on, energy stored in the capacitor CLC flows into the coil LLC and a resonance phenomenon occurs. In case of a load such as the incandescent lamp 5 (FIG. 17) and the like that needs much current, even if a current is vibrated, the TRIAC is not turned off. However, in a case of a small load like the LED load 400 (FIG. 15, FIG. 16), the current flowing in the TRIAC Tri becomes equal to or smaller than the holding current (e.g., about 10 mA) and the TRIAC Tri is likely to be turned off. At this time, because of the following two phenomena, flickering of the LED load 400 occurs.

First, after the TRIAC Tri is turned off because of the resonance phenomenon and the like, a trigger voltage is applied again to the TRIAC Tri, whereby the TRIAC Tri is turned on again within an identical a.c. half period (within 10 ms of half period in a case of 50 Hz). At this time, the timing the TRIAC Tri is turned on does not stabilize at every a.c. half period and the energy supplied to the LED load 400 does not stabilize, whereby the flickering of the LED load 400 occurs.

Second, like in the case where the incandescent lamp 5 is connected with the phase control type light adjuster 200 (FIG. 17), if the on state of the TRIAC Tri is kept until the a.c. power supply voltage V1 becomes nearly 0 V, the capacitor CLC is not charged at the timing the next a.c. half period begins. However, in a case where the TRIAC Tri is turned off when the a.c. power supply voltage V1 is a high voltage (e.g., 50 V in 100 VAC), the capacitor CLC is charged because of currents flowing in the LED load 400, the LED drive circuits 300 and 500; accordingly, in the next a.c. half period, the phase angle at which the TRIAC Tr1 is turned on deviates. The charge amount in the capacitor CLC changes, whereby the phase angle at which the TRIAC Tri is turned on changes and the flickering of the LED load 400 occurs.

Here, an example of the conventional LED drive circuit is disclosed in JP-A-2006-319172; this LED drive circuit has a resistor and a capacitor in an output stage. However, this resistor is intended to prevent a rush current and the capacitor is intended to remove noise, but is not intended to alleviate the resonance phenomenon of the phase control type light adjuster.

SUMMARY OF THE INVENTION

It is an object of the present invention to provide an LED drive circuit and an LED illumination light that are able to alleviate a current holding portion (e.g., a TRIAC and the like) of a phase control type light adjuster being turned off by a resonance phenomenon within an identical half period of an a.c. voltage and alleviate flickering of the LED.

An LED drive circuit according an aspect of the present invention is an LED drive circuit that is connectable to an a.c. power supply via a phase control type light adjuster and drives an LED load, and is structured to include:

a discharge portion that consumes energy of a resonance phenomenon generated by a light adjuster capacitance component of the phase control type light adjuster and a light adjuster inductance component of the phase control type light adjuster when a current holding portion of the phase control type light adjuster is turned on.

Besides, in the above structure, a discharge portion resistance component of the discharge portion and a discharge portion capacitance component of the discharge portion and the light adjuster inductance component may meet a formula (1):

$$RD^2-4\times LLC/CD\geq 0 \quad (1)$$

where RD: a resistance value (Ω) of the discharge resistance component; LLC: an inductance value (μH) of the light adjuster inductance component; CD: a capacitance value (μF) of the discharge portion capacitance component.

Besides, in any one of the above structures, the discharge portion resistance component of the discharge portion and the light adjuster inductance component may meet a formula (2):

$$RD\geq 4.6\times LLC/td \quad (2)$$

where RD: the resistance value (Ω) of the discharge resistance component; LLC: the inductance value (μH) of the light adjuster inductance component; td: a response time (μs) of the current holding portion.

Besides, in any one of the above structures, the resistance value of the discharge portion resistance component is changeable so as to meet the formula (1) or the formula (2) in accordance with the inductance value of the light adjuster inductance component.

Besides, any one of the above structures may include a changeover control portion that changes on/off of a bypass function of the discharge portion resistance component of the discharge portion in accordance with a magnitude of an input current.

Besides, any one of the above structures may include an edge detection portion that detects a rising edge of an a.c. voltage controlled in phase, and at a detection time, turns off the bypass function of the discharge portion resistance component of the discharge portion for a predetermined time.

Besides, any one of the above structures may include a bypass changeover portion that turns on the bypass function of the discharge portion resistance component of the discharge portion in a case where an input current is large or a case of a state where the a.c. voltage controlled in phase is not the rising edge, and turns off the bypass function in a case where the input current is small and the a.c. voltage controlled in phase is the rising edge.

Besides, an LED drive circuit according to an aspect of the present invention that is connectable to an a.c. power supply via a phase control type light adjuster and drives an LED load, wherein the phase control type light adjuster is structured to have: a current holding portion; a light adjuster capacitance component; and a light adjuster inductance component, and include an electricity storage portion that flows a rush current when the current holding portion is turned on.

Besides, in the above structure, an electricity storage portion inductance component of the electricity storage portion, an electricity storage portion capacitance component of the electricity storage portion, the light adjuster capacitance component and the light adjuster inductance component may meet a formula (3):

$$CC\times LC\geq 4\times CLC\times LLC \quad (3)$$

where CC: a capacitance value (F) of the electricity storage portion capacitance component; LC: an inductance value (H) of the electricity storage portion inductance component; CLC: a capacitance value (F) of a capacitance that includes the light adjuster capacitance component; LLC: the inductance value (H) of the light adjuster inductance component.

Besides, any one of the above structures incudes a discharge portion that consumes energy of a resonance phenomenon generated by the light adjuster capacitance component and the light adjuster inductance component when the current holding portion is turned on; and the discharge portion resistance component of the discharge portion, the electricity storage portion inductance component of the electricity storage portion and the electricity storage portion capacitance component of the electricity storage portion may meet a formula (4):

$$RD^2-4\times LC/CC\geq 0 \quad (4)$$

where RD: the resistance value (Ω) of the discharge resistance component; LC: the inductance value (μH) of the electricity storage portion inductance component; CC: the capacitance value (μF) of the electricity storage portion capacitance component.

Besides, in the above structure, the capacitance value of the electricity storage portion capacitance component may be changeable so as to meet the formula (3) in accordance with the capacitance value of the light adjuster capacitance component and/or the inductance value of the light adjuster inductance component.

Besides, in the above structure, the resistance value of the discharge portion resistance component may be changeable so as to meet the formula (4) in accordance with the capacitance value of the light adjuster capacitance component and/or the inductance value of the light adjuster inductance component.

Besides, any one of the above structures may include a changeover control portion that changes the capacitance value of the electricity storage portion capacitance component of the electricity storage portion in accordance with the magnitude of the input current.

Besides, in the above structure, when it is changed from current supply from the phase control type light adjuster and the electricity storage portion to the current supply from the electricity storage portion within an a.c. half period, a current may not be supplied from the phase control type light adjuster within an identical a.c. half period.

Besides, the above structure may include an input current detection portion that stops the current supply from the phase control type light adjuster on detecting that the input current disappears.

Besides, the above structure may include an current control portion that turns off a current flowing in the LED load on detecting a predetermined phase angle.

Besides, an LED drive circuit according to an aspect of the present invention that is connectable to an a.c. power supply via a phase control type light adjuster, drives an LED load, and is structured to include:

a switching device;

a switching current detection portion;

an LED current detection portion;

a first control portion that based on a detection signal from the switching current detection portion, performs switching control of the switching device so as to make the switching current constant;

a second control portion that based on a detection signal from the LED current detection portion, performs switching control of the switching device so as to make the LED current constant; and a changeover portion that changes control so as to perform the control by the first control portion in a case where an a.c. voltage controlled in phase is a threshold value or smaller and perform the control by the second control portion in a case where the a.c voltage controlled in phase exceeds the threshold value.

Besides, an LED drive circuit according to an aspect of the present invention that is connectable to an a.c. power supply via a phase control type light adjuster, drives an LED load, and is structured to include:

a capacitance component;

a control portion that controls an LED current to be constant; wherein when an a.c. voltage controlled in phase rises, a charge current flows into the capacitance component because of control by the control portion.

An LED illumination light according to the present invention is structured to include the LED drive circuit having any one of the above structures and an LED load connected with an output side of the LED drive circuit.

DESCRIPTION OF PREFERRED EMBODIMENTS

Hereinafter, an embodiment of the present invention is described with reference to drawings.

(First Embodiment)

Figure 1:
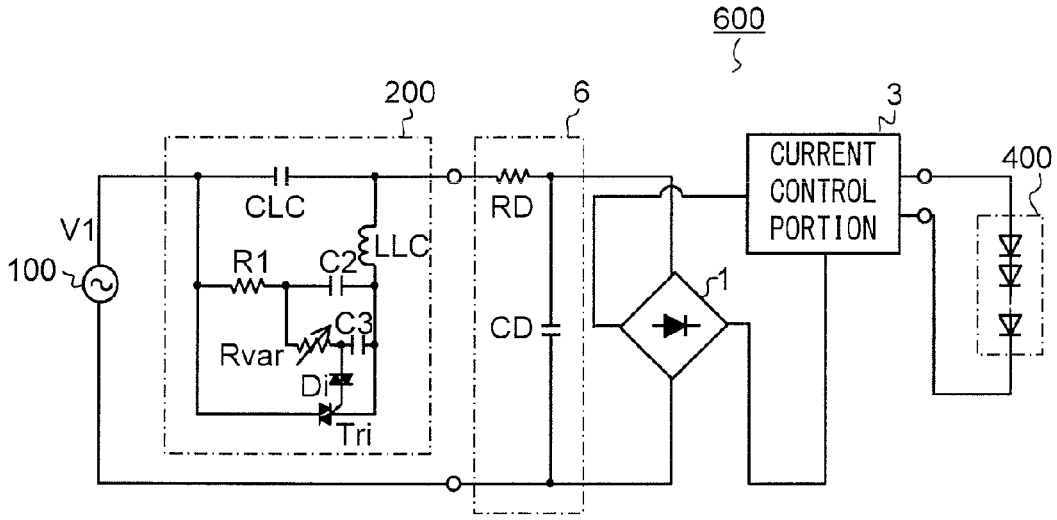
FIG. 1 is a structural view showing an LED illumination system according to a first embodiment of the present invention.
Figure 16:
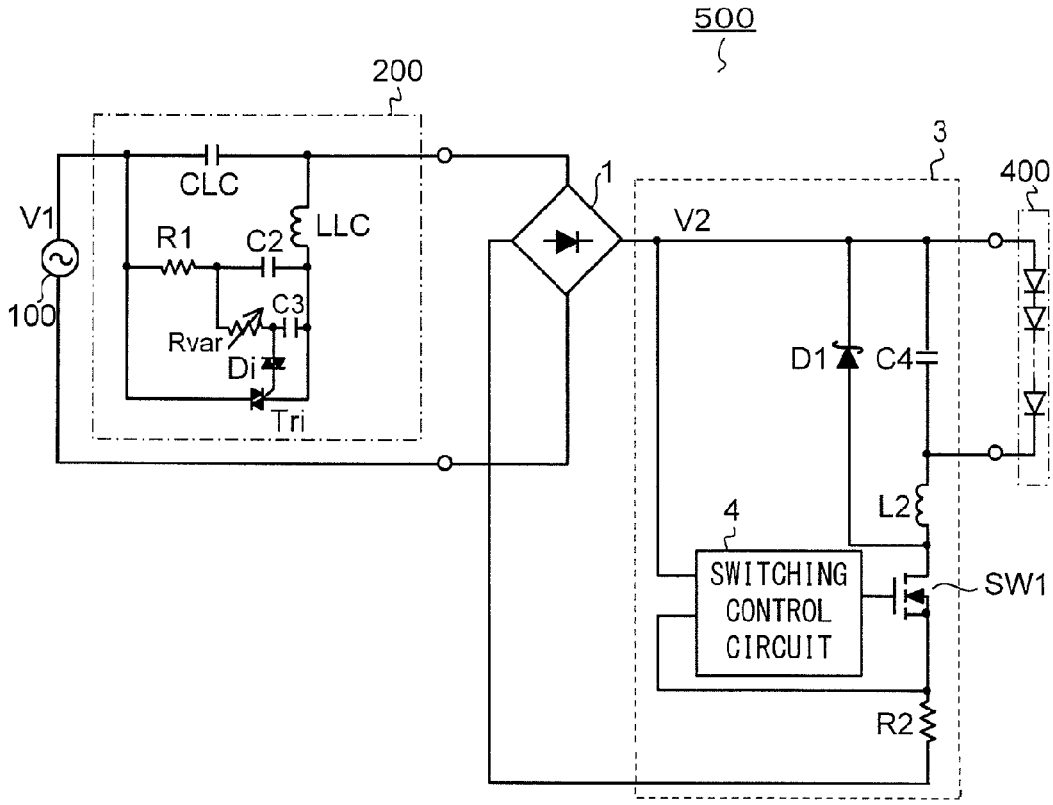
Related Art Fig.16
FIG. 16 is a view showing a conventional example of an LED illumination system.
Figure 17:
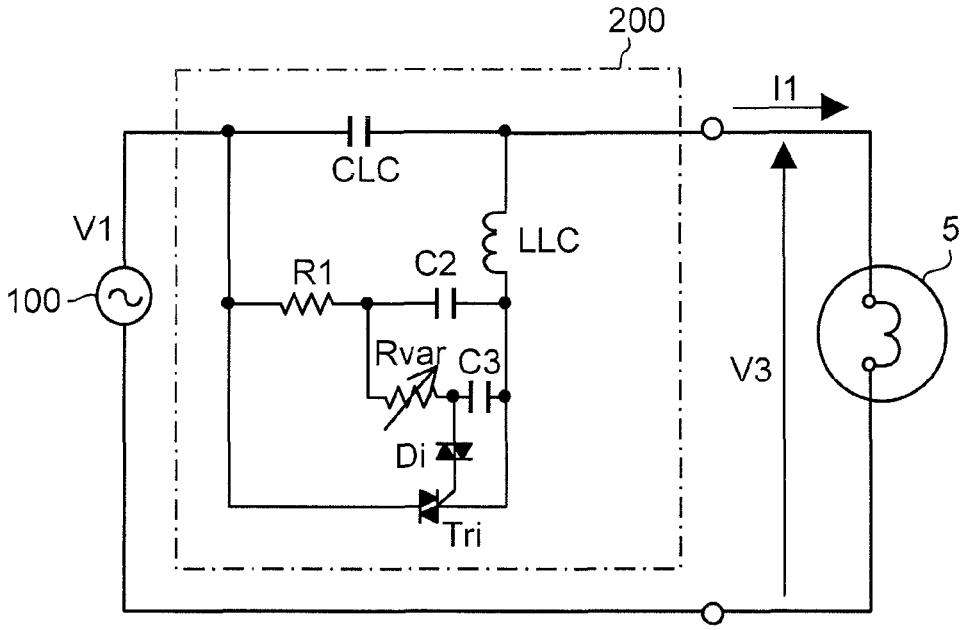
Related Art Fig.17
FIG. 17 is a view showing a conventional example of an incandescent lamp illumination system.
Figure 18:
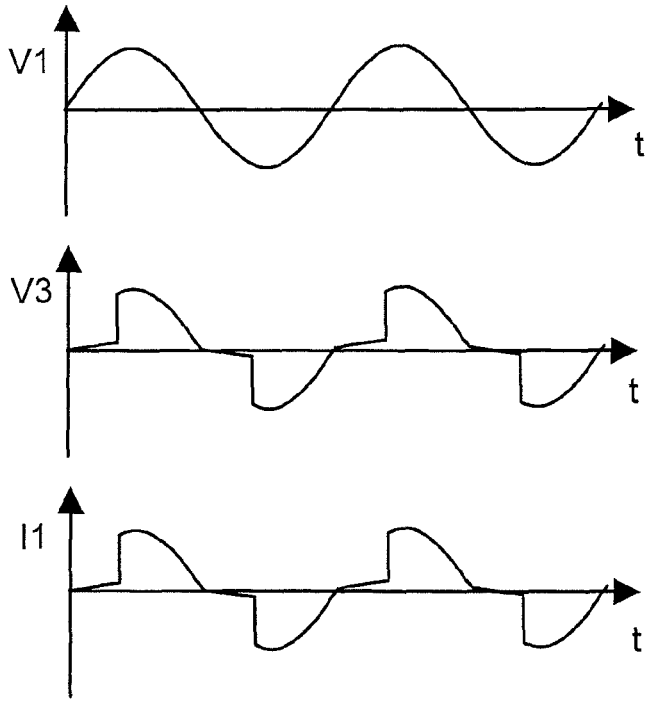
Related Art Fig.18
FIG. 18 is a timing chart of each portion in a conventional example of an incandescent lamp illumination system.

FIG. 1 shows a structure of an LED illumination system according to a first embodiment of the present invention. An LED drive circuit 600 of the LED illumination system shown in FIG. 1 has: the full-wave rectifier 1; the current control portion 3; and a discharge portion 6. The discharge portion 6 is composed of a series RC circuit that includes a discharge resistor RD (discharge portion resistance component) and a discharge capacitor CD (discharge portion capacitance component). Here, the current control portion 3 has the above structure shown in FIG. 16; however, the current control portion may have another structure (hereinafter, the same applies).

The TRIAC Tri (current holding portion) in the phase control type light adjuster (hereinafter, simply called the "light adjuster") 200 is turned on at a phase angle of the a.c. power supply voltage V1, whereby the capacitor CLC (light adjuster capacitance component) and the coil LLC (light adjuster inductance component) in the light adjuster 200 resonate with each other; the current flowing in the TRIAC Tri vibrates; the TRIAC Tri is turned off at timing the absolute value of the current becomes equal to or smaller than the holding current, so that the light adjuster 200 is likely to malfunction. Because of it, the resonance energy is consumed by means of the discharge portion 6.

Here, to prevent the coil LLC in the light adjuster 200 and the discharge capacitor. CD from resonating with each other, the following formula (1) is met. Considering an a.c. equivalent circuit (voltage source short) that includes only the coil LLC, the discharge resistor RD and the discharge capacitor CD, the formula (1) is obtained as a condition that a current in the series LCR circuit does not become a vibration solution.

$$RD^2-4\times LLC/CD\geq 0 \quad (1)$$

where RD: a resistance value (Ω) of the discharge resistor RD; LLC: an inductance value (μH) of the coil LLC; CD: a capacitance (μF) of the discharge capacitor CD.

For example, in a case where LLC=100 μH; CD=0.1 μF, RD is set at 63Ω or more. In this way, by meeting the formula (1), it is possible to prevent the resonance phenomenon from occurring and it is possible to prevent the TRAIC Tri from being turned off because of the resonance phenomenon when the TRAIC Tri is turned on. Accordingly, it is possible to prevent the malfunction of the light adjuster 200 and alleviate the flickering of the LED load 400.

Besides, even if the current flowing in the TRAIC Tri vibrates and the absolute value of the current becomes equal to or smaller than the holding current because of the resonance phenomenon between the capacitor CLC and the coil LLC that occurs when the TRIAC Tri is turned on, the TRAIC Tri is not immediately turned off because of a response time td of the TRAIC Tri. Even if the absolute value of the TRAIC current becomes equal to or smaller than the holding current, a TRAIC current equal to or larger than the holding current flows again within the response time td, whereby the TRAIC Tri is not turned off. By sufficiently decreasing the energy of the resonance phenomenon between the capacitor CLC and the coil LLC within the response time td, it is possible to prevent the TRAIC Tri from being turned off.

Here, the resonance current is expressed as I=Is×EXP (−RD/LLC×t) (where Is: the initial value of the resonance current; RD: the resistance value of the discharge resistor RD; LLC: the inductance of the coil LLC). When RD/LLC×t=4.6, EXP (−RD/LLC×t)=about 1/100. Because of this, by meeting the following formula (2), it is possible to make the resonance current equal to or smaller than 1/100 during the response time td.

$$RD\geq 4.6\times LLC/td \quad (2)$$

where RD: the resistance value (Ω) of the discharge resistor RD; LLC: the inductance (μH) of the coil LLC; td: the response time (μs) of the TRIAC Tri.

For example, in a case where LLC=100 μH; td=80 μs, RD is set at 5.75Ω or more. In a case where LLC is large (e.g., 2 mH and the like), RD is likely to become too large to meet the above formula (1). At this time, by meeting the above formula (2), it is possible to prevent the TRIAC Tri from being turned off after being turned on.

Figure 2:
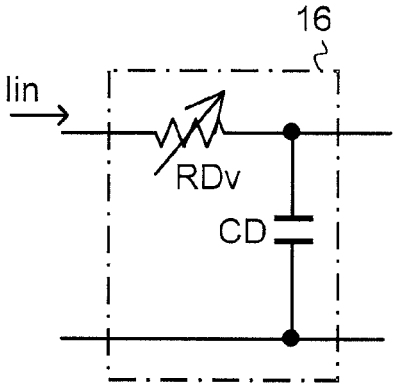
FIG. 2 is a view showing a modification of a discharge portion.

FIG. 2 shows a discharge portion 16 that is modification of the discharge portion 6. The discharge portion 16 is composed of a series RC circuit that includes: a discharge resistor RDv composed of a variable resistor; and a discharge capacitor CD. The discharge resistor RDv is connected in series with the current control portion 3; accordingly, currents flowing in the current control portion 3 and the LED load 400 are subjected to a loss because of a resistance component. Because of this, it is desirable that the resistance component of the discharge portion 16 is low. Accordingly, by changing and setting the resistance value of the discharge resistor RDv composed of the variable resistor in accordance with a circuit constant of the light adjuster 200, it is possible to improve power supply efficiency.

For example, in a case where the a.c. power supply voltage V1=100 V (rms); power necessary for the LED=6 W; LLC=100 μH; CD=0.1 μF; and td=80 μs, it is assumed that the discharge resistor RDv is set at 70Ω so as to meet the above formulae (1) and (2). An input current Iin (FIG. 2) becomes about 6 W/100 V=60 mV; accordingly, the loss at the resistance component of 70Ω becomes 0.252 W (4.2% of 6 W). Besides, in a case where LLC=500 μH in this example, RD becomes equal to or more than 141Ω from the formula (1) and RD becomes equal to or more than 29Ω from the formula (2); accordingly, it assumed that the discharge resistor RDv is set at 150Ω. In this case, the loss at the resistance component of 150Ω becomes 0.54 W (9% of 6 W).

Here, as for the discharge resistor RDv, various examples are employable. For example, the resistance value may be varied by a user or a setting operator by means of a knob in accordance with a light adjuster. Or, by detecting a circuit constant of a light adjuster by means of an IC, a plurality of resistors prepared in advance may be changed by means of a switch in accordance with the detection result. Or, by detecting a circuit constant of a light adjuster by means of an IC and controlling a resistor composed of a MOS transistor by means of a control signal corresponding to the detection result, the on resistance value may be changed. Further, a plurality of resistors are prepared in advance and the resistance value may be selectively set by means of soldering.

Figure 3A:
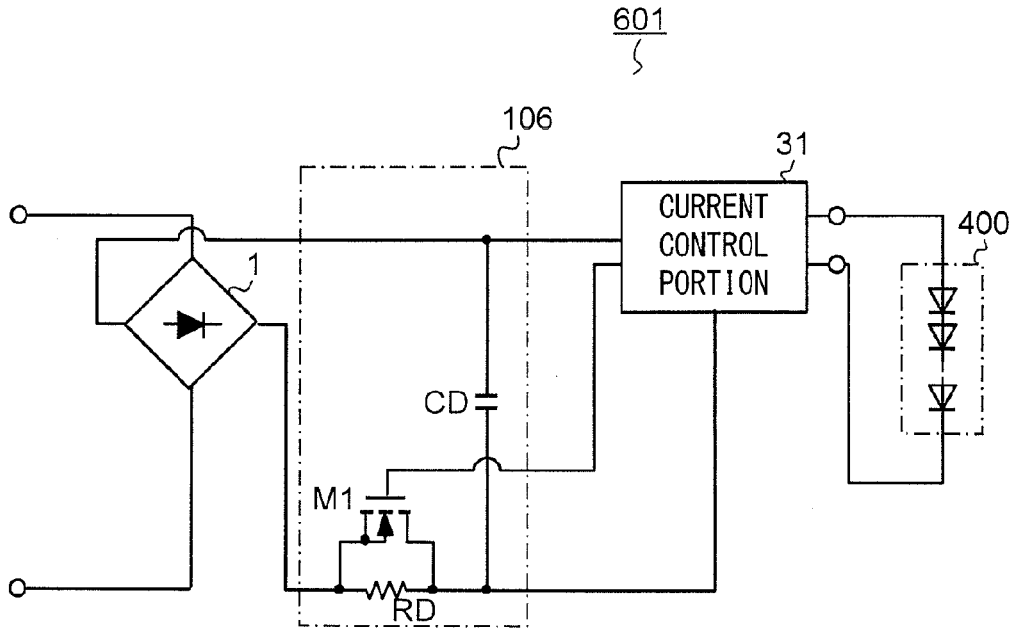
FIG. 3A is a view showing a modification of an LED drive circuit according to the first embodiment of the present invention.

Besides, FIG. 3A shows an LED drive circuit 601 that is a modification of the LED drive circuit 600 (FIG. 1). In the LED drive circuit 601, a discharge portion 106 is connected between the full-wave rectifier 1 and a current control portion 31. The discharge portion 106 has a MOS transistor M1 besides the discharge resistor RD and the discharge capacitor CD connected in series with each other. The discharge resistor RD is connected across a source and a drain of the MOS transistor M1, and a gate is connected with the current control portion 31. On detecting that the input current is small, the current control portion 31 sends a control signal to the gate to turn off the MOS transistor M1 and sets the resistance value of the resistance component high. In contrast, on detecting that the input current is large, the current control portion 31 sends a control signal to the gate to turn on the MOS transistor M1, turns on a bypass function, and sets the resistance value of the resistance component low. In this way, decline in the power supply efficiency is alleviated.

Figure 3B:
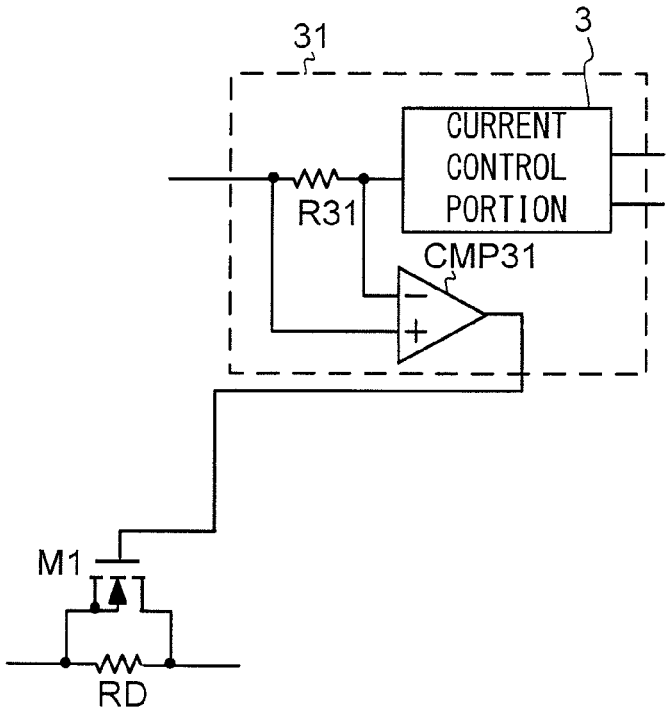
FIG. 3B is a view showing a structural example of a current control portion.

FIG. 3B shows a structural example of the current control portion 31 shown in FIG. 3A. The current control portion 31 shown in FIG. 3B has: the current control portion 3; a resistor R31 connected in series with the current control portion 3; and a comparator CMP31 inputs of which are connected with both ends of the resistor R31 and an output of which is connected with the gate of the MOS transistor M1.

Figure 3C:
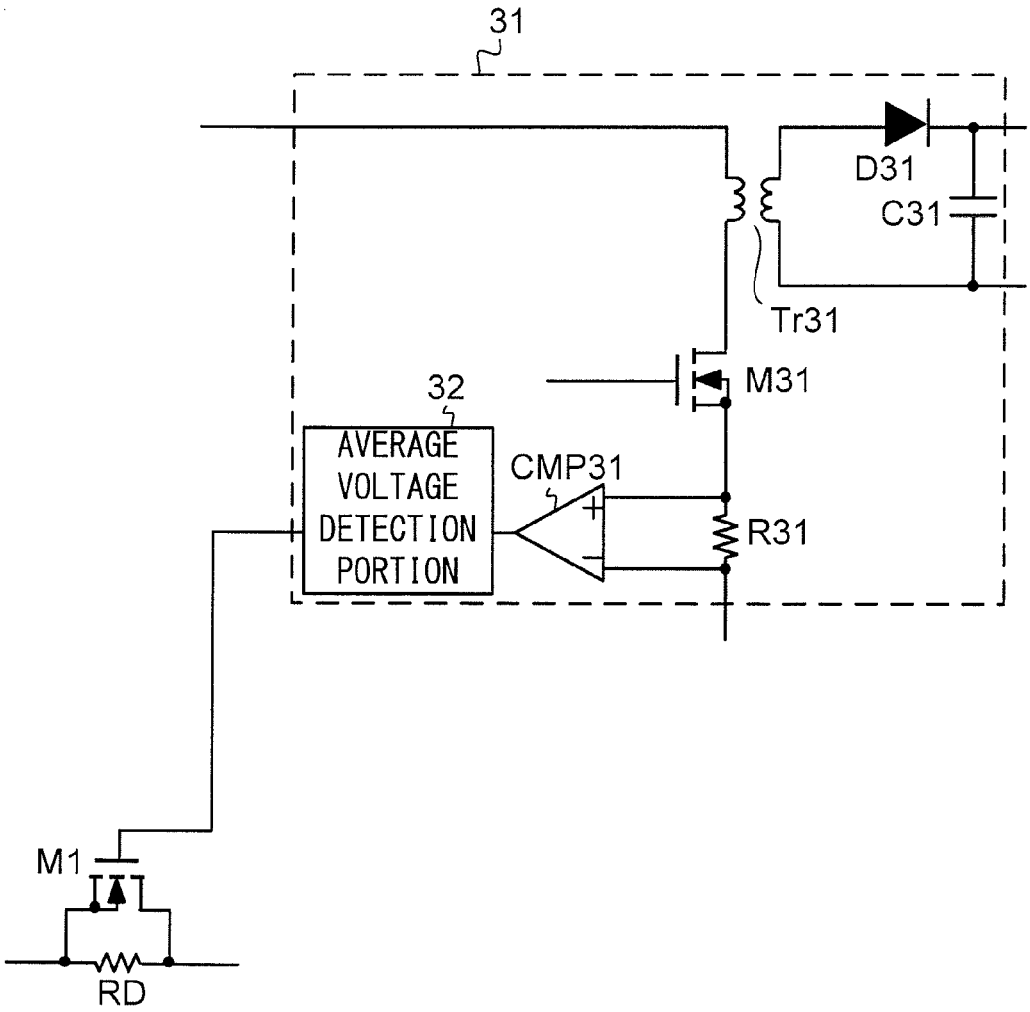
FIG. 3C is a view showing another structural example of a current control portion.

Besides, FIG. 3C shows another structural example of the current control portion 31. The current control portion 31 shown in FIG. 3C is a current control portion of fly back type. The current control portion 31 has: a resistor R31 that detects a current flowing in a MOS transistor M31; a comparator CMP31 inputs of which are connected with both ends of the resistor R31; and an average voltage detection portion 32 that detects an average voltage of an output from the comparator CMP31 and outputs the detected signal to the gate of the MOS transistor M1.

Figure 3D:
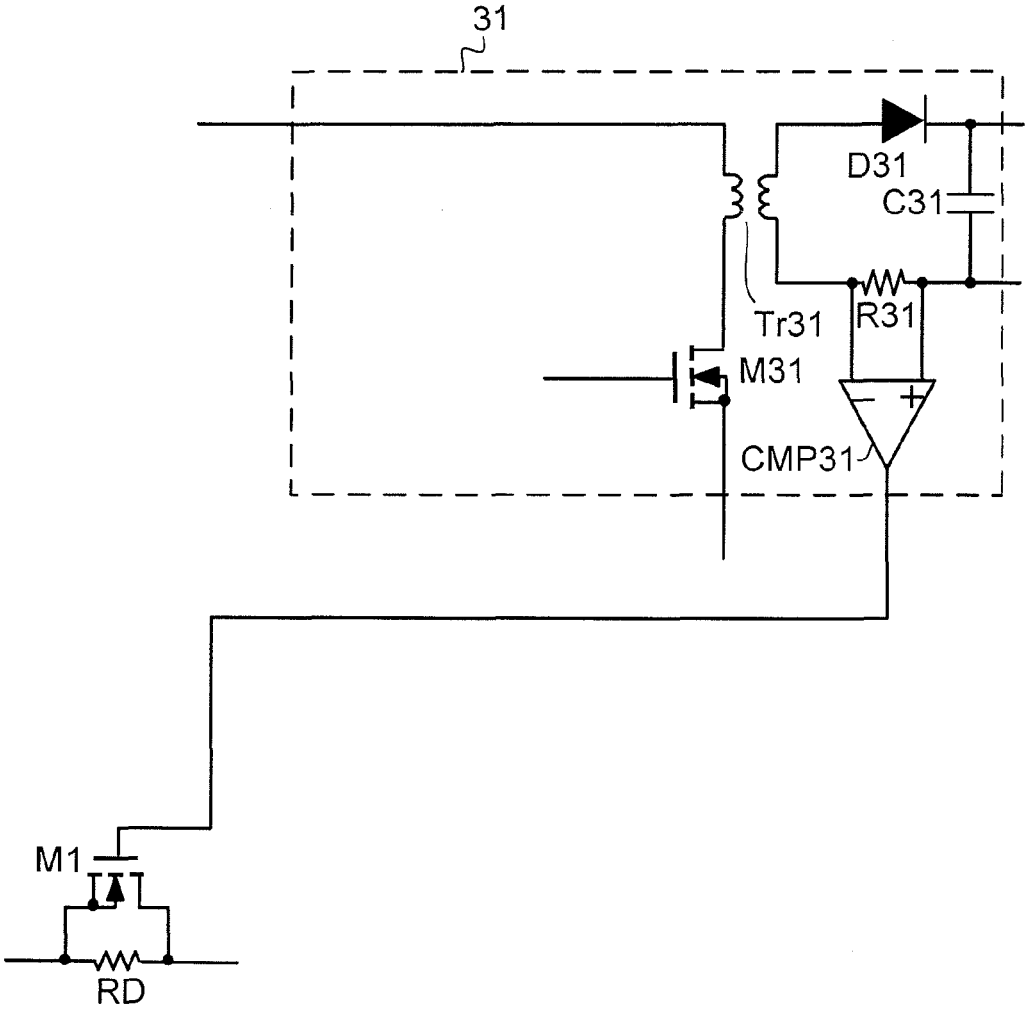
FIG. 3D is a view showing another structural example of a current control portion.

Besides, FIG. 3D shows another structural example of the current control portion 31 of fly back type. The current control portion 31 shown in FIG. 3D has: the resistor R31 for detecting a current of an LED that is connected with one end of a secondary coil of a transformer Tr31 and with one end of a smoothing capacitor C31; and the comparator CMP31 to the input of which both ends of the resistor R31 are connected and the output of which is connected with the gate of the MOS transistor M1.

Figure 4A:
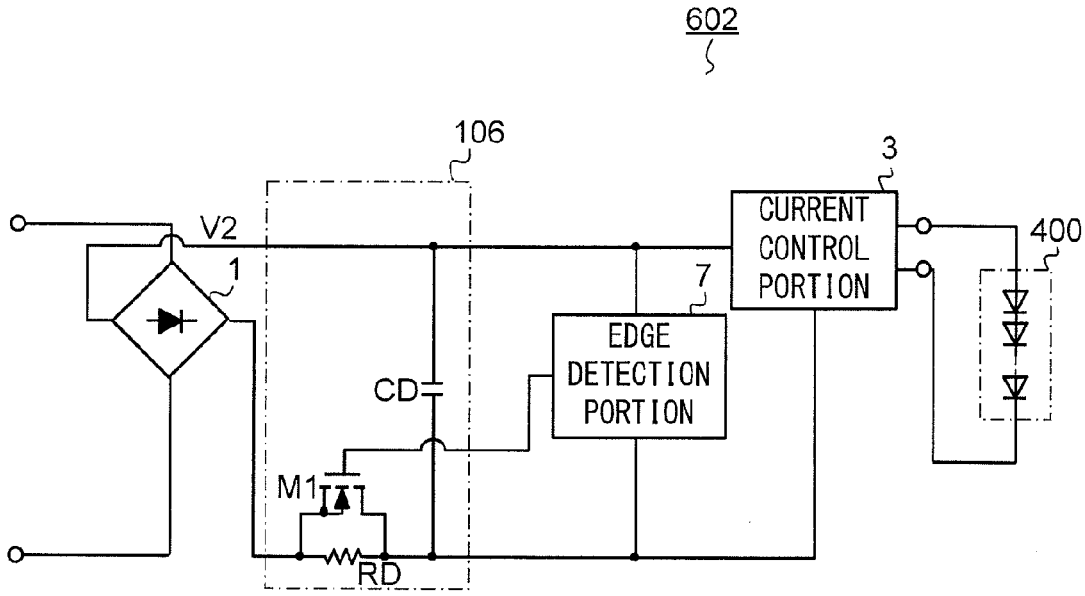
FIG. 4A is a view showing a modification of the LED drive circuit according to the first embodiment of the present invention.

FIG. 4A shows a structure of an LED drive circuit 602 that is a modification of the LED drive circuit 601 (FIG. 3A). The LED drive circuit 602 has the discharge portion 106 and an edge detection portion 7. The edge detection portion 7 detects rising of the output voltage V2 from the full-wave rectifier 1 and sends a control signal to the MOS transistor M1 to turn off a bypass function for a predetermined time. In this way, when the TRIAC Tri is turned on, the resistance value of the resistance component of the discharge portion 106 is set high, whereby it is possible to alleviate the resonance phenomenon in the light adjuster 200.

Figure 4B:
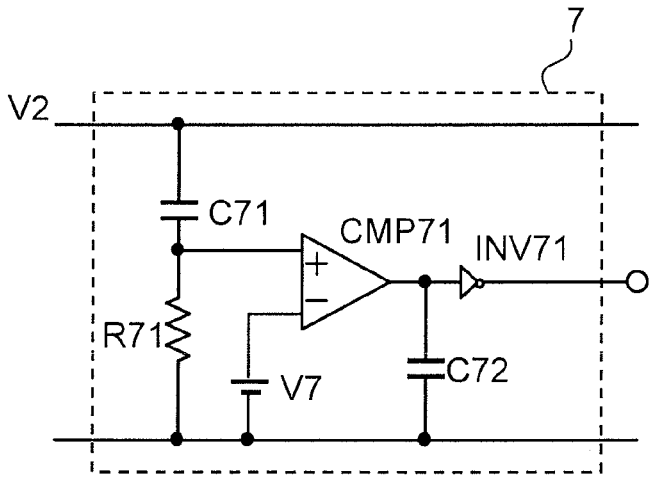
FIG. 4B is a view showing a structural example of an edge detection portion.

FIG. 4B shows a first example of the edge detection portion 7. The edge detection portion 7 shown in FIG. 4B has: capacitors C71, C72; a resistor R71; a comparator CMP71; and an inverter INV71. The capacitor C71 and the resistor R71 are connected in series across a plus output and a minus output of the full-wave rectifier 1, and a connection point between them is connected with a non-inverting terminal of the comparator CMP71. A reference voltage V7 is input to an inverting terminal of the comparator CMP71. An output of the comparator CMP71 is connected in common with one end of the capacitor C72 and an input of the inverter INV71. An output of the inverter INV71 is connected with the gate of the MOS transistor M1 (FIG. 4A).

When the output voltage V2 from the full-wave rectifier 1 rises, a High level output signal is output from the comparator CMP71 for a predetermined time. The output signal is inverted by the inverter INV71, shaped in waveform and output to the gate of the MOS transistor M1. In this way, the MOS transistor M1 is turned off for a predetermined time, the bypass function is turned off, and the resistance value of the resistance component is set high. Thereafter, a High level signal is output from the inverter INV71 to the gate of the MOS transistor M1; accordingly, the MOS transistor M1 is turned on, the bypass function is turned on, and the resistance value of the resistance component is set low.

Figure 4C:
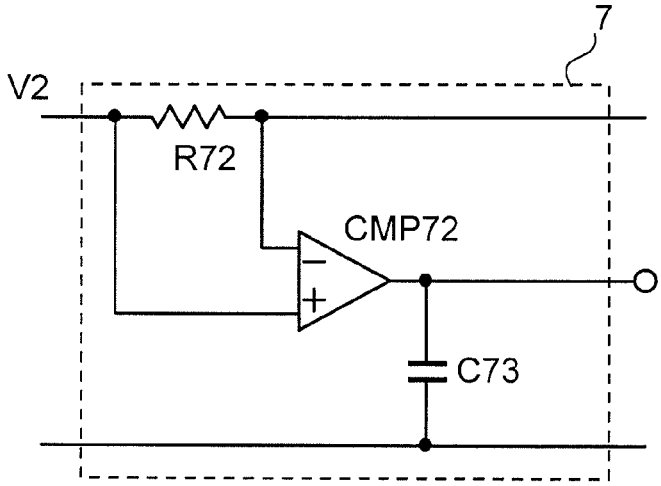
FIG. 4C is a view showing a structural example of an edge detection portion.

Besides, FIG. 4C shows a second example of the edge detection portion 7. The edge detection portion 7 shown in FIG. 4C has: a resistor R72; a comparator CMP72; and a capacitor C73. The resistor R72 is connected across the plus output of the full-wave rectifier 1 and the current control portion 3. One end and the other end of the resistor R72 are connected with a non-inverting terminal and an inverting terminal of the comparator CMP72, respectively. An output of the comparator CMP72 is connected in common with one end of the capacitor C73 and the gate of the MOS transistor M1 (FIG. 4A).

When the output voltage V2 from the full-wave rectifier 1 rises, a current begins to flow in the resistor R72; however, because the capacitor C73 is charged, a Low level signal is output from the comparator CMP72 to the gate of the MOS transistor M1 for a predetermined time. In this way, the MOS transistor M1 is kept turned off for a predetermined time, the bypass function is turned off, and the rsistance value of the resistance component is set high. Thereafter, a High level signal is output from the comparator CMP72 to the gate of the MOS transistor M1; accordingly, the MOS transistor M1 is turned on, the bypass function is turned on, and the resistance value of the resistance component is set low.

Figure 5:
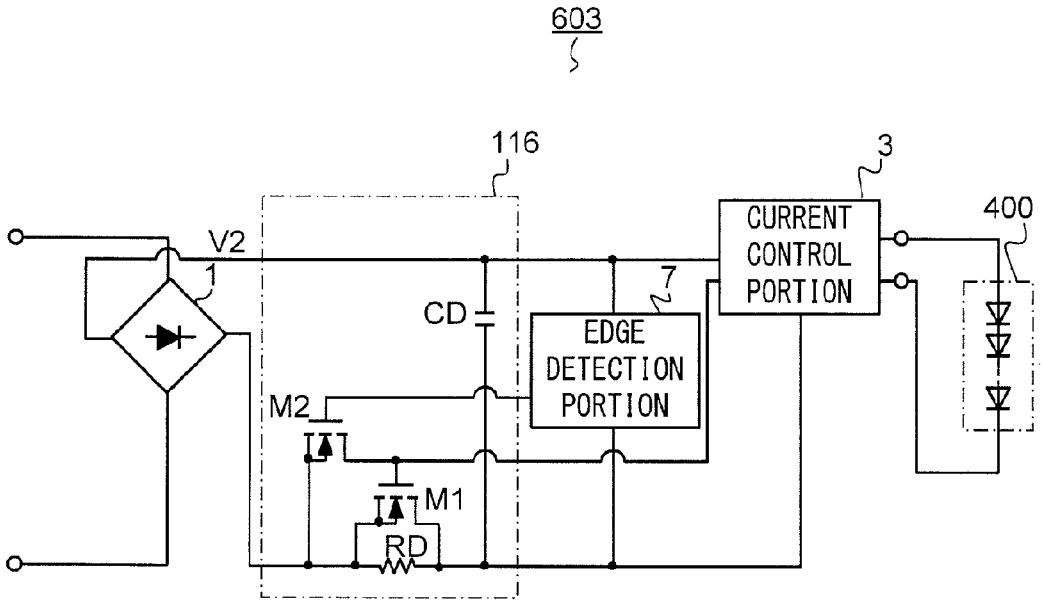
FIG. 5 is a view showing a modification of the LED drive circuit according the first embodiment of the present invention.

FIG. 5 shows an LED drive circuit 603 that is a modification of the LED drive circuit 602. A discharge portion 116 of the LED drive circuit 603 shown in FIG. 5 has: the discharge resistor RD; the discharge capacitor CD; and MOS transistors M1 and M2. A source of the MOS transistor M2 is connected with the minus output of the full-wave rectifier 1; a drain is connected in common with the gate of the MOS transistor M1 and the current control portion 3; and a gate is connected with the edge detection portion 7.

If the current control portion 3 determines that a current subtracted from the input is large and sends a control signal to the MOS transistor M1 to turn on the MOS transistor M1 or the edge detection portion 7 sends a control signal to the MOS transistor M2 in such a way that the edge detection portion 7 turns on the MOS transistor M2 in a state where the output voltage V2 from the full-wave rectifier 1 does not rise, the bypass function is turned on and the power supply efficiency is improved. In contrast, if the current control portion 3 determines that the current subtracted from the input is small and sends a control signal to the MOS transistor M1 to turn off the MOS transistor M1 and the edge detection portion 7 sends a control signal to the MOS transistor M2 to turn off the MOS transistor M2 when the edge detection portion 7 detects the rising of the output voltage V2 from the full-wave rectifier 1, the bypass function is turned off and a resistance value of a resistance component of the discharge portion 116 is set high. In this way, it is possible to alleviate the resonance phenomenon in the light adjuster 200 when the TRIAC Tri is turned on and prevent the TRIAC Tri from being turned off.

(Second Embodiment)

Figure 6A:
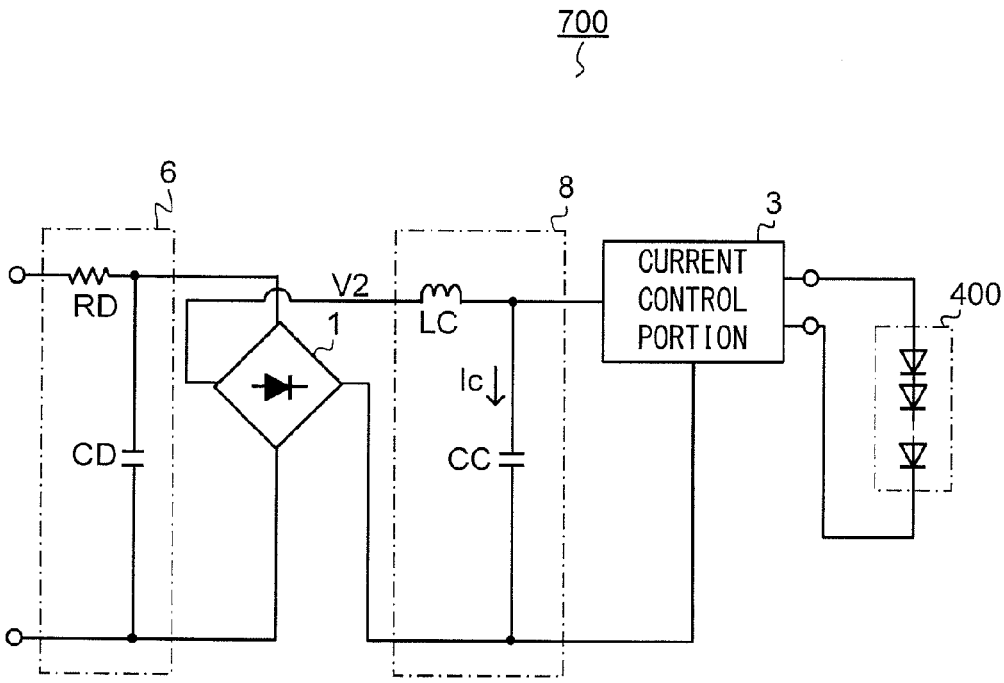
FIG. 6A is a structural view showing an LED drive circuit according to a second embodiment of the present invention.
Figure 6B:
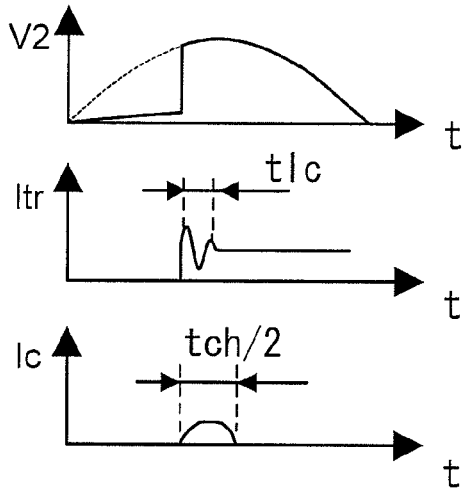
FIG. 6B is a timing chart of each portion in the second embodiment of the present invention.

Besides, FIG. 6A shows a structure of an LED drive circuit 700 according to a second embodiment of the present invention. The LED drive circuit 700 has the discharge portion 6 and an electricity storage portion 8. The electricity storage portion 8 is composed of a series LC circuit that includes a coil LC (electricity storage portion inductance component) and a capacitor CC (electricity storage portion capacitance component). When the TRIAC Tri in the light adjuster 200 is turned on, a rush current flows into the capacitor CC of the electricity storage portion 8; accordingly, a large current flows temporarily in the TRAIC Tri. FIG. 6B shows a timing chart of each portion of FIG. 6A. From a top stage of FIG. 6B, there indicated are: the output voltage V2 from the full-wave rectifier 1; a current Itr of the TRIAC Tri; and a current Ic of the capacitor CC.

To prevent the absolute value of the current Itr from becoming equal to or smaller than the holding current because of vibration when the TRIAC Tri is turned on and the voltage V2 rises, at least in the electricity storage portion 8, it is necessary to flow a rush current at timing the vibration reaches a valley. To achieve this, a period tch of the rush current needs to be two times a vibration period tlc of the current Itr or more. The respective periods are expressed as:

$$tlc=2\times\pi\sqrt{(CLC\times LLC)}$$

$$tch=2\times\pi\sqrt{(CC\times LC)}$$

Accordingly, it is necessary to meet the following formula (3).

$$CC\times LC\geq 4\times CLC\times LLC \quad (3)$$

where CC: a capacitance (F) of the capacitor CC; LC: an inductance (H) of the coil LC; CLC: a resultant capacitance (F) of the capacitor CLC and the capacitor CD; LLC: an inductance (H) of the coil LLC.

In a case where the above formula (3) is not met, the operation of flowing the rush current by means of the electricity storage portion 8 ends earlier than the timing (timing the current becomes smallest) the vibration of the current Itr of the TRIAC Tri due to the resonance phenomenon between the capacitor CLC and the coil LLC in the light adjuster 200 reaches the valley; accordingly, there is a case where the current flowing in the TRIAC Tri becomes equal to or smaller than the holding current at the valley of the vibration of the current Itr. Accordingly, the TRIAC Tri is turned off, which leads to malfunction of the light adjuster 200 and flickering of the LED.

Here, in a case of a structure in which the discharge portion 6 is not disposed, CLC in the above formula (3) may be set at the capacitance of the capacitor CLC in the light adjuster 200.

Further, to alleviate the resonance phenomenon due to the coil LC and the capacitor CC in the electricity storage portion 8, it is desirable to meet the following formula (4).

$$RD^2-4\times LC/CC\geq 0 \quad (4)$$

where RD: the resistance value (Ω) of the discharge resistor RD; LC: the inductance (μH) of the coil LC; CC: the capacitance (μF) of the capacitor CC.

Figure 7:
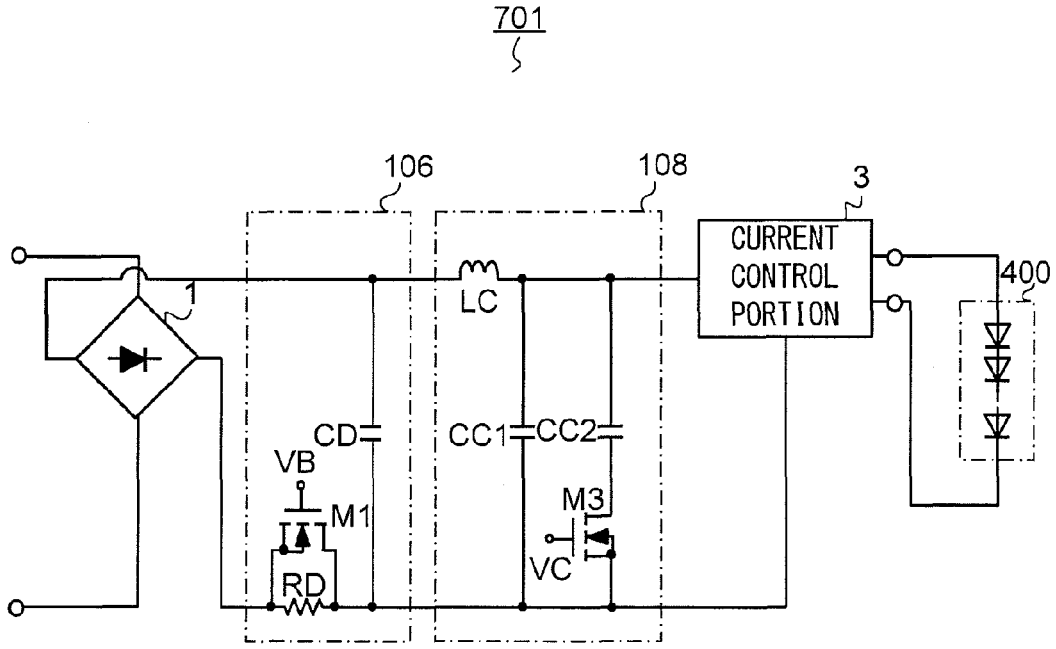
FIG. 7 is a view showing a modification of the LED drive circuit according the second embodiment of the present invention.

Next, FIG. 7 shows a structure of an LED drive circuit 701 that is a modification of the LED drive circuit 700 according to the second embodiment. The LED drive circuit 701 has the discharge portion 106 and an electricity storage portion 108. The electricity storage portion 108 has: the coil LC; capacitors CC1 and CC2 that are each connected in series with the coil LC and in parallel with each other; and a MOS transistor M3. A control signal VB for the MOS transistor M1 and a control signal VC for the MOS transistor M3 are output from an IC (not shown) that detects the circuit constant of the light adjuster 200.

In a case where the capacitance of the capacitor CLC and the inductance of the coil LLC in the light adjuster 200 are small, it is possible to make a capacitance component CC of the electricity storage portion 108 small based on the above formula (3). Accordingly, if it is detected by means of the IC that the capacitance of the capacitor CLC and the inductance of the coil LLC are small, the MOS transistor M3 is turned off by means of the control signal VC and the capacitor CC1 only is made active. In contrast, in a case where the capacitance of the capacitor CLC and the inductance of the coil LLC in the light adjuster 200 are large, the MOS transistor M3 is turned on by means of the control signal VC and the capacitors CC1 and CC2 are made active, whereby the capacitance component of the electricity storage portion 108 is made large to meet the above formula (3). In this way, it is possible to change the capacitance component of the electricity storage portion 108 in accordance with the circuit constant of the light adjuster 200 and make the rush current suitable.

Besides, in a case where the capacitance of the capacitor CLC and the inductance of the coil LLC in the light adjuster 200 are small, it is possible to make the capacitance component LC of the electricity storage portion 108 small based on the above formula (3) (it is possible to selectively set the coil LC by means of soldering, for example). Accordingly, it is possible to make the resistance value of the resistance component of the discharge portion 106 small based on the above formula (4). Accordingly, if it is detected by means of the IC that the capacitance of the capacitor CLC and the inductance of the coil LLC are small, the MOS transistor M1 is turned on by means of the control signal VB and the resistance value of the resistance component of the discharge portion 106 is made small. In contrast, if it is detected by means of the IC that the capacitance of the capacitor CLC and the inductance of the coil LLC are large, the MOS transistor M1 is turned off by means of the control signal VB and the resistance value of the resistance component of the discharge portion 106 is made large. In this way, it is possible to make the power supply efficiency suitable in accordance with the circuit constant of the light adjuster 200.

Here, instead of using the MOS transistor, the capacitance component of the electricity storage portion 108 and the resistance component of the discharge portion 106 may be varied by the user or the setting operator by means of a switch.

Figure 8:
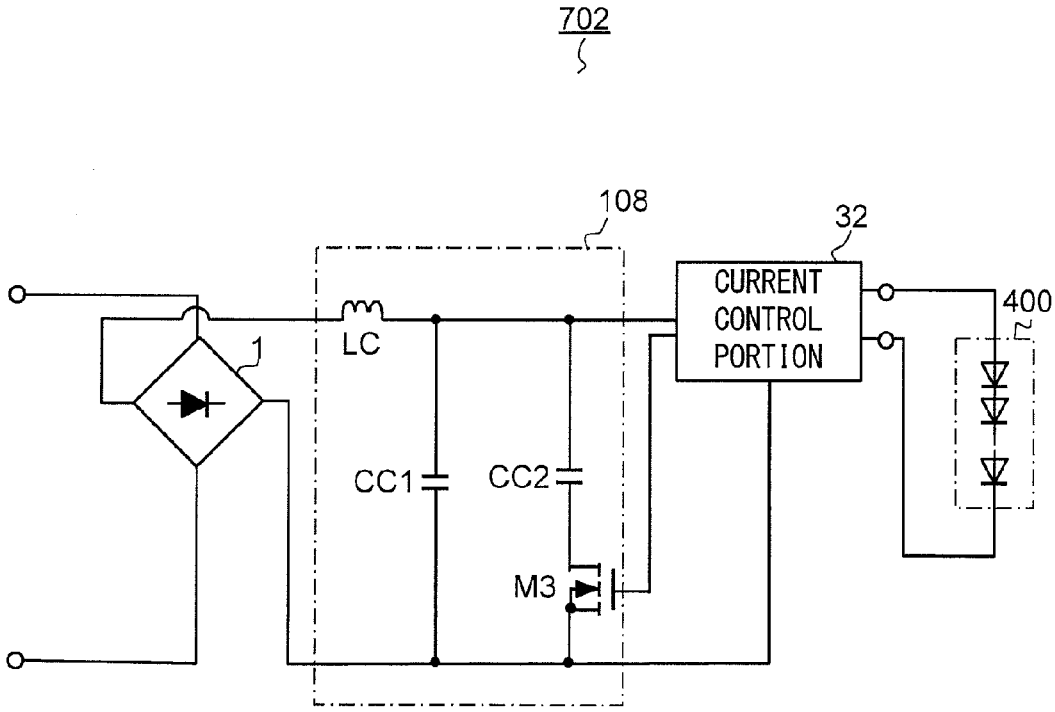
FIG. 8 is a view showing a modification of the LED drive circuit according the second embodiment of the present invention.

Besides, FIG. 8 shows a structure of an LED drive circuit 702 that is another modification of the LED drive circuit 700. A gate of the MOS transistor M3 of the electricity storage portion 108 of the LED drive circuit 702 is connected with a current control portion 32. When the current control portion 32 determines that a current subtracted from the input is large, the capacitance component of the electricity storage portion 108 may be small; accordingly, the MOS transistor M3 is turned off by means of the control signal and the capacitor CC 1 only is made active. In this way, it is possible to reduce the rush current. Here, for example, a structure of the current control portion 32 may be a structure in which the output from the comparator is inverted in the current control portion 31 shown in FIG. 3B to FIG. 3D.

(Third Embodiment)

Figure 9A:
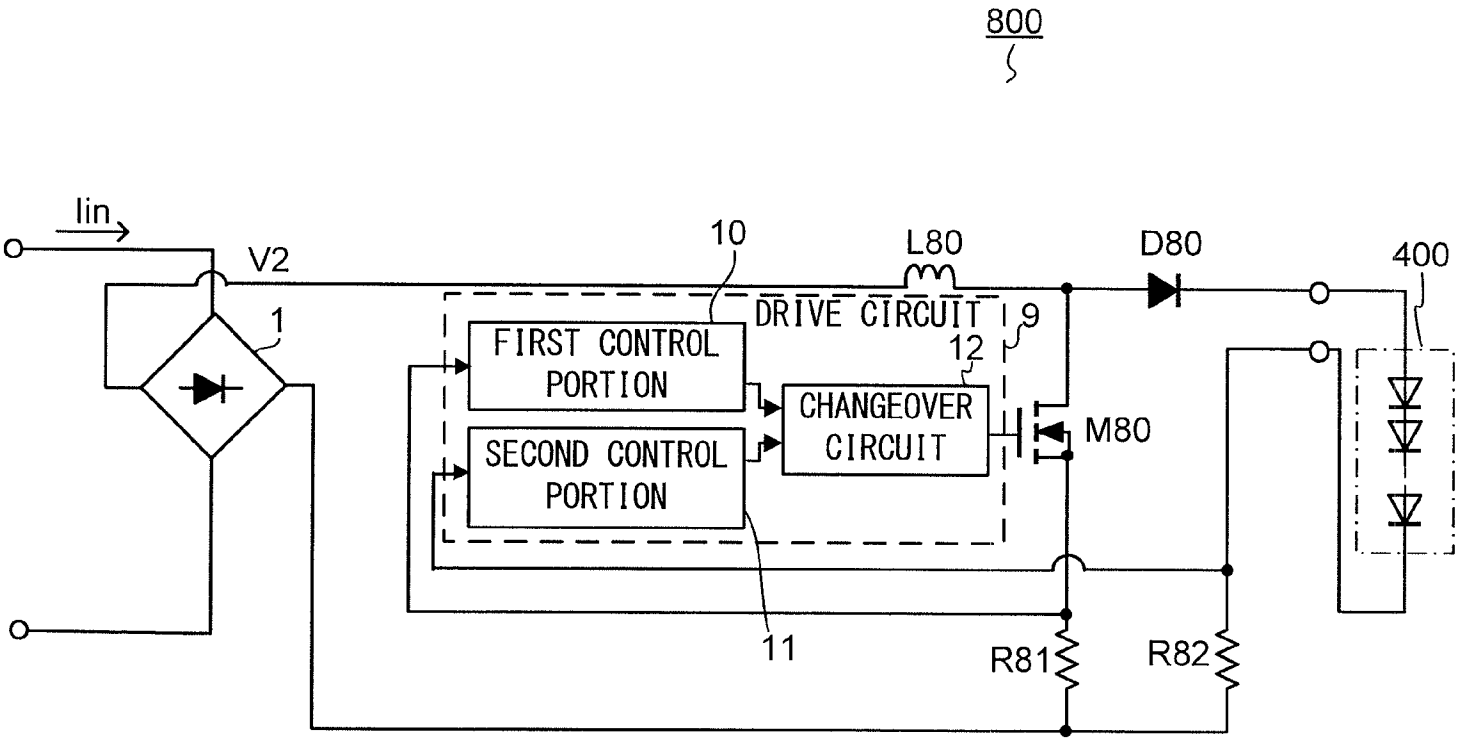
FIG. 9A is a structural view showing an LED drive circuit according to a third embodiment of the present invention.

FIG. 9A shows a structure of an LED drive circuit 800 according to a third embodiment of the present invention. The LED drive circuit 800 has: a drive circuit 9; a coil L80; a diode D80; resistors R81, R82; and a MOS transistor M80. The drive circuit 9 has a first control portion 10; a second control portion 11; and a changeover circuit 12. The first control portion 10 performs switching control of the MOS transistor M80 based on a switching current detection signal from the resistor R81 and controls the switching current to be constant. The second control portion 11 performs the switching control of the MOS transistor M80 based on an LED current detection signal from the resistor R82 and controls the LED current to be constant. The changeover circuit 12 changes outputs from the first control portion 10 and the second control portion 11 to be sent to the MOS transistor M80.

Figure 9B:
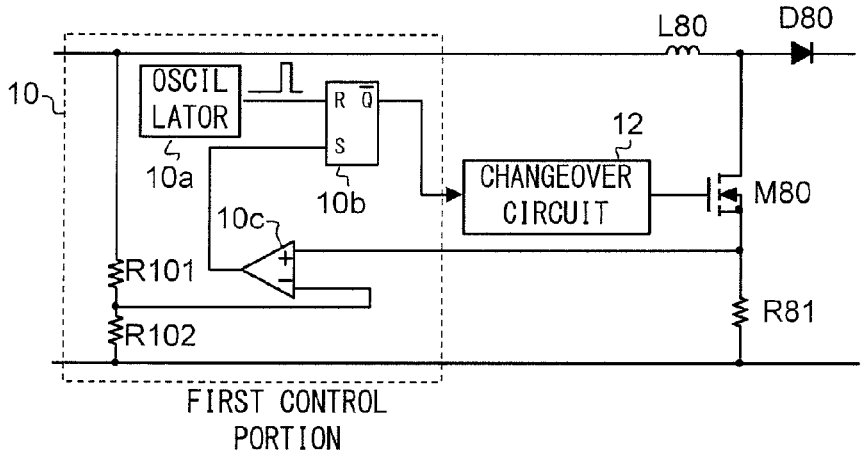
FIG. 9B is a view showing a structural example of a first control portion.

FIG. 9B shows a structural example of the first control portion 10. A switching power supply portion is composed of a voltage step-up converter, and the resistor R81 as a switching current detector is connected across the switching device M80 and a reference voltage line. The first control portion 10 has: a comparator 10*c*; an oscillator 10*a*; an RS flip-flop 10*b* as a latch circuit. And, a voltage obtained by applying voltage conversion to the switching current by means of the resistor R81 is input to a non-inverting terminal of the comparator 10*c*. A voltage divided by resistors R101 and R102 connected in series across the input power supply line and the reference voltage line is input to an inverting terminal as a reference voltage, and an output from the comparator 10*c* is input to a set terminal of the RS flip-flop 10*b*. Besides, an output from the oscillator 10*a* that generates pulses is input to a reset terminal of the RS flip-flop 10*b*, and an output from a $\overline{Q}$ output terminal is input to the changeover circuit 12. According to this structure, a signal is output from the output of the oscillator 10*a* to turn on the switching device M80, while a signal is output from the output of the comparator 10*c* to turn off the switching device M80. By using the latch circuit like the RS fli-flop 10*b*, it is possible to avoid a malfunction loop of the current detection→the switching device turning off→the current non-detection→the switching device turning on→the current detection→ . . . .

Figure 9C:
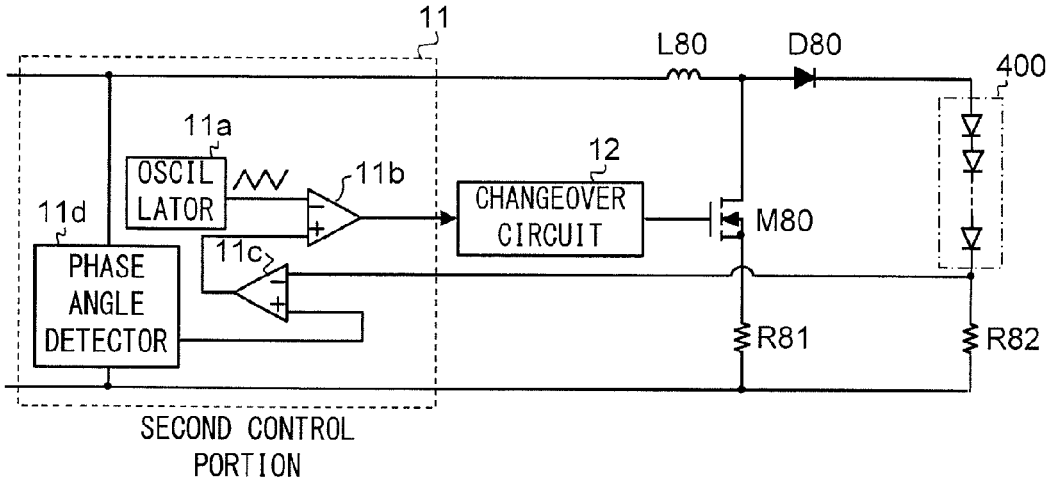
FIG. 9C is a view showing a structural example of a second control portion.

Besides, FIG. 9C shows a structural example of the second control portion 11. The second control portion 11 has: an error amplifier 11*c*: an oscillator 11*a*; a comparator 11*b*; and a phase angle detector 11*d*. A voltage, which is obtained by applying voltage conversion to the LED current by means of the resistor 82 as the LED current detector, is input to an inverting terminal of the error amp 11*c*, while an output from the phase angle detector 11*d* is input to a non-inverting terminal. And, an output from the error amp 11*c* is input to a non-inverting terminal of the comparator 11*b*; an output from the oscillator 11*a* that generates a triangular wave is input to an inverting terminal; and an output from the comparator 11*b* is input to the changeover circuit 12. In a case where the LED current is small, the output from the error amp 11*c* becomes large, and a pulse width of the pulse output from the comparator 11*b* becomes long.

Figure 9D:
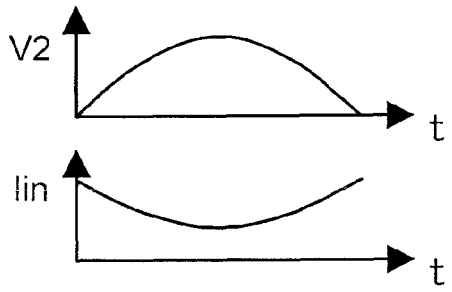
FIG. 9D is a timing chart in a case where LED current constant control is performed.

Here, if control is performed to make the LED current constant over an entire range of the output voltage V2 from the full-wave rectifier 1, the output power becomes constant over the entire range; accordingly, the input current Iin for the LED drive circuit 800 becomes a downward concave curve as shown in FIG. 9D (in FIG. 9D, in a case where the output voltage V2 rises at a point because of the phase control, the input current Iin also rises at the timing). Accordingly, there is a case where the input current Iin becomes small near a point where the output voltage V2 becomes maximum; the TRIAC current becomes equal to or smaller than the holding current because of the resonance phenomenon at the time the TRIAC Tri in the light adjuster 200 is turned on, whereby the TRIAC Tri is turned off. For example, when the power given to the LED is 4 W, a peak voltage of the output voltage V2 becomes 141 V in a case where the a.c. voltage is 100 V (rms); accordingly, the minimum current of the input current Iin in FIG. 9D becomes 4/141=28 mA. If it is assumed that the TRIAC current decreases by 18 mA because of the resonance phenomenon at the time the TRIAC Tri is turned on, the TRIAC Tri is turned off in a case where the TRIAC current becomes 10 mA and the holding current is 10 mA.

Figure 9E:
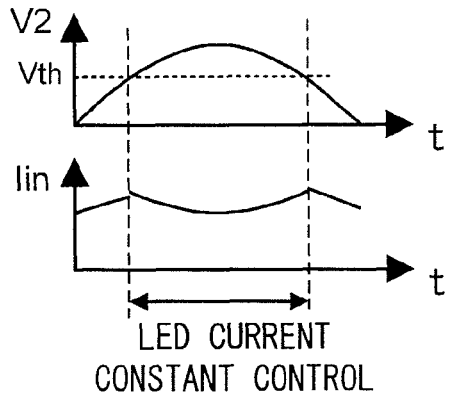
FIG. 9E is a timing chart in a case where current control according the third embodiment of the present invention is performed.

Accordingly, in the LED drive circuit 800, as shown in FIG. 9E, in a case where the output voltage V2 is equal to or smaller than a threshold value Vth, the changeover circuit 12 sends the output from the first control portion 10 to the MOS transistor M80 to control the switching current to be constant; in a case where the output voltage V2 exceeds the threshold value Vth, the changeover circuit 12 sends the output from the second control portion 11 to the MOS transistor M80 to control the LED current to be constant (in FIG. 9E, in a case where the output voltage V2 rises at a point because of the phase control, the input current Iin also rises at the timing). In this way, the input current Iin becomes substantially constant; even if the resonance phenomenon occurs in the light adjuster 200, the TRIAC current does not become equal to or smaller than the holding current, so that it is possible to prevent the TRIAC Tri from being turned off. In the case of FIG. 9E, the input current Tin is decided for an average voltage of 90 V of the a.c. voltage; accordingly, the minimum current of the input current Tin becomes 4/90=44 mA, so that even if the TRIAC current decreases by 18 mA because of the resonance phenomenon as described above, the input current Iin does not become equal to or smaller than the holding current and it is possible to prevent the TRIAC Tri from being turned off. Accordingly, it is possible to alleviate the flickering of the LED.

(Fourth Embodiment)

Figure 10A:
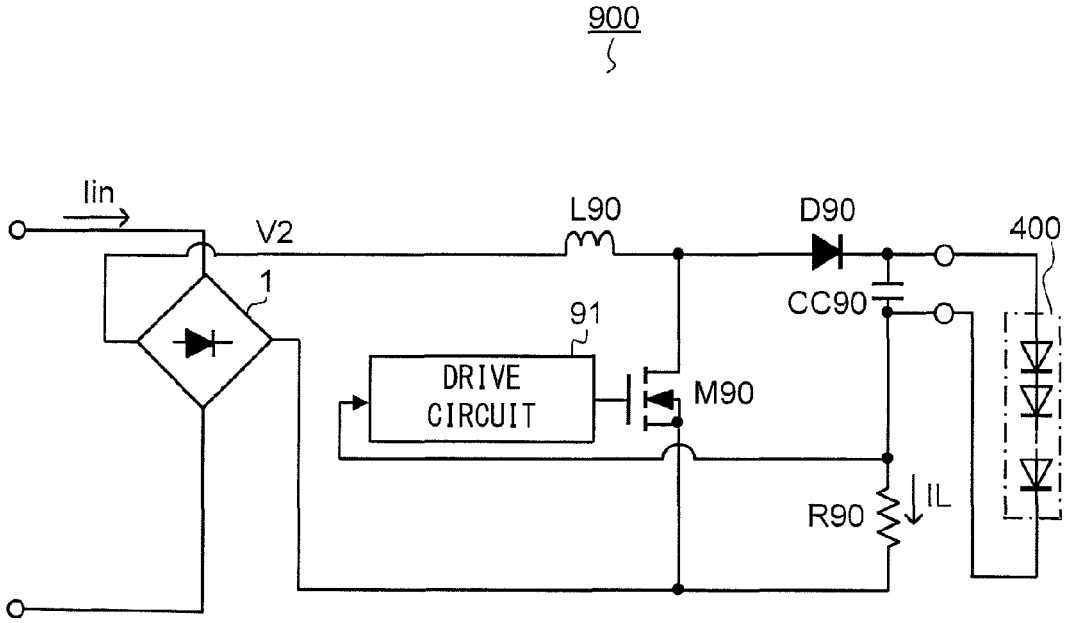
FIG. 10A is a structural view of an LED drive circuit according to a fourth embodiment of the present invention.

FIG. 10A shows a structure of an LED drive circuit 900 according to a fourth embodiment of the present invention. The LED drive circuit 900 has: a drive circuit 91; a coil L90; a diode D90; a capacitor CC90; a resistor R90; and a MOS transistor M90. The drive circuit 91, based on an LED current detection signal by the resistor R90, performs switching control of the MOS transistor M90, thereby controlling the LED current to be constant.

Figure 10B:
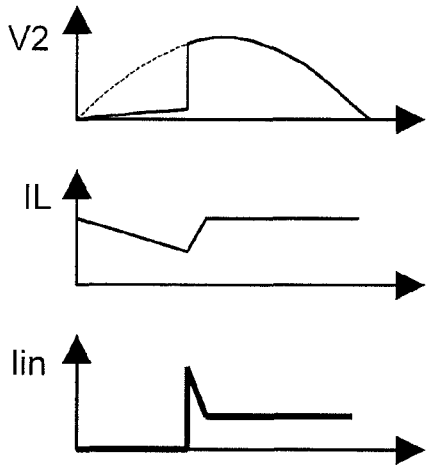
FIG. 10B is a timing chart of each portion in the fourth embodiment of the present invention.

FIG. 10B shows a timing chart of each portion in the LED drive circuit 900. The TRIAC Tri in the light adjuster 200 is turned on and the output voltage V2 from the full-wave rectifier 1 rises. Accordingly, because of the drive circuit 91 controlling an LED current IL to be constant, a charge current for the capacitor CC90 flows by the LED current IL reaches a set value. In this way, the input current Iin becomes large temporarily; even if the resonance phenomenon occurs in the light adjuster 200, the TRIAC current does not become equal to or smaller than the holding current and it is possible to prevent the TRIAC Tri from being turned off (here, FIG. 10B shows that the input current Iin becomes large, thereafter, constant; however, exactly describing, the input current Iin draws a downward concave curve).

(Fifth Embodiment)

Figure 11:
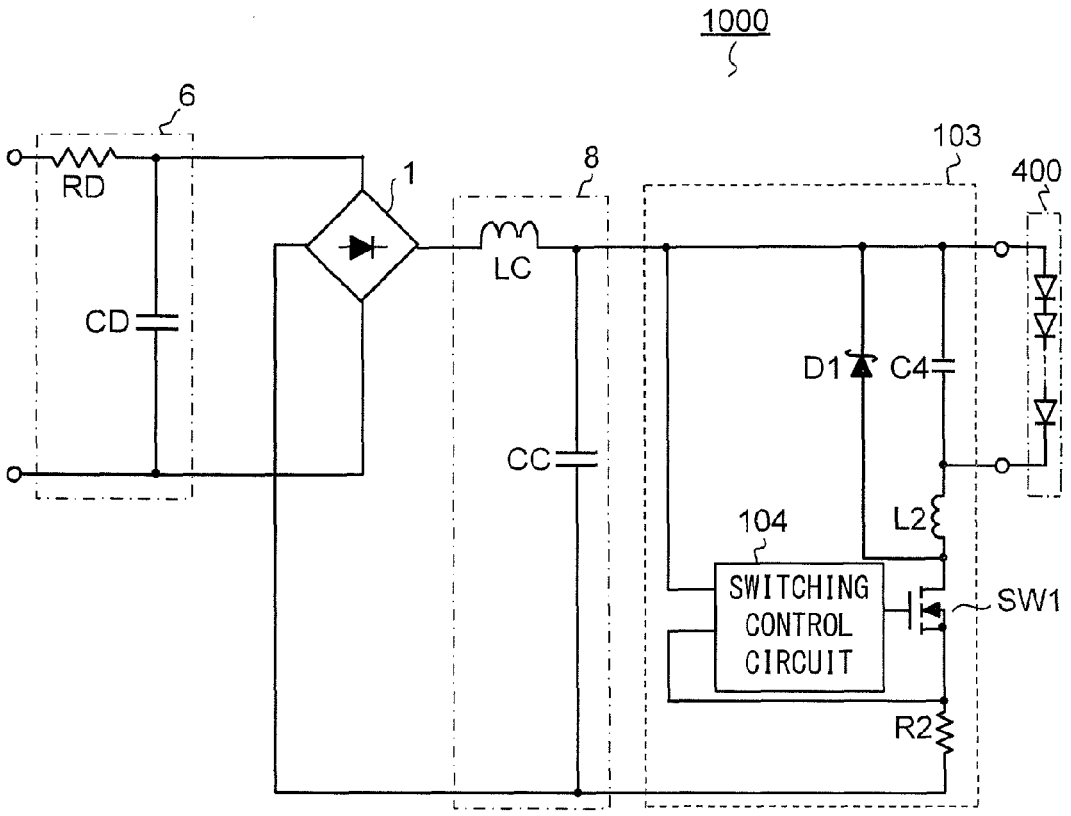
FIG. 11 is a structural view of an LED drive circuit according to a fifth embodiment of the present invention.
Figure 12A:
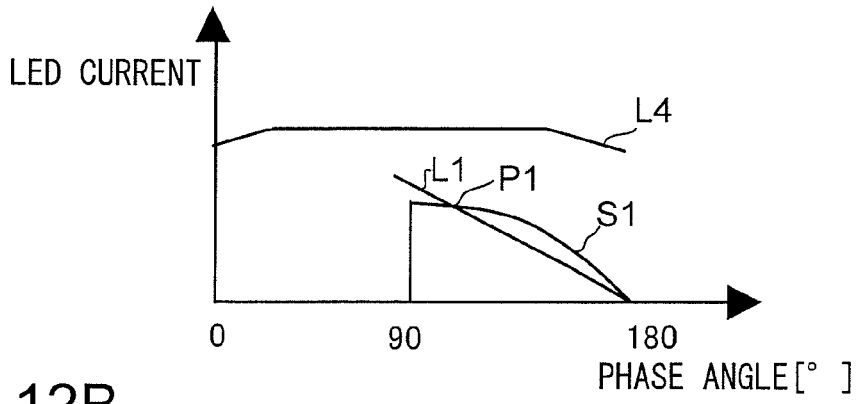
FIG. 12A is a view showing an example of an operation line of an LED current.

Next, FIG. 11 shows a structure of an LED drive circuit 1000 according to a fifth embodiment of the present invention. The LED drive circuit 1000 has: the discharge portion 6; the electricity storage portion 8; and a current control portion 103. A switching control circuit 104 of the current control portion 103 detects the phase angle of the a.c. voltage, and controls the LED current changing an LED current target value in accordance with the detected phase angle. In this way, the LED current is controlled to draw an operation line L1 shown in FIG. 12A. An arc region S1 shown in FIG. 12A is a region where the current is not supplied from the light adjuster 200 and the current is supplied from the capacitor CC of the electricity storage portion 8. The current is supplied from both the light adjuster 200 and the capacitor CC until the operation line L1 intersects the arc region S1 at an intersection P1; however, at the timing of the intersecting at the intersection P1, the current supply from the light adjuster 200 is stopped; accordingly, the TRIAC Tri is turned off. Thereafter, the operation line L1 is present in the arc region S1 within the identical a.c. half period; accordingly, the current is supplied from the capacitor CC and is not supplied from the light adjuster 200.

Figure 12B:
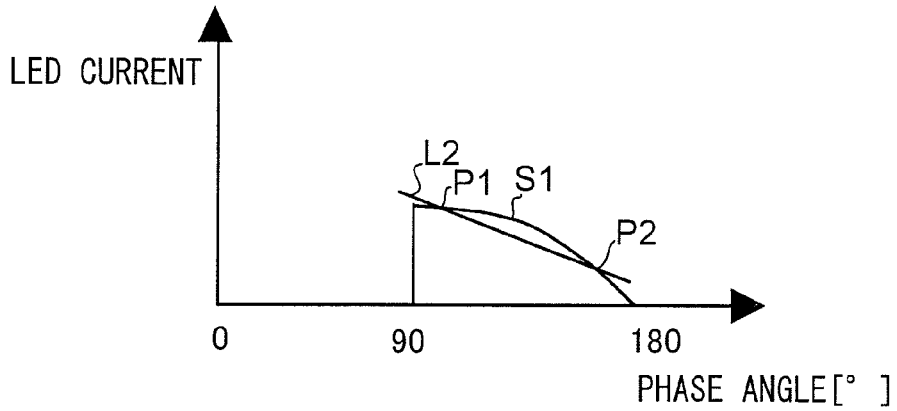
FIG. 12B is a view showing an example of an operation line of an LED current.

If an operation line L2 intersects the arc region S1 at intersections P1 and P2 as shown in FIG. 12B, the TRIAC Tri is turned off at the intersection P1; thereafter, going beyond the intersection P2, the current is supplied from not only the capacitor CC but also the light adjuster 200; accordingly, the capacitor CLC in the light adjuster 200 is charged. In this way, during the next a.c. half period, the phase angle where the TRIAC Tri is turned on deviates; consequently, the flickering of the LED occurs. In contrast, according to the operation line L1 (FIG. 12A), after the TRIAC Tri is turned off, the current is not supplied from the light adjuster 200 within the identical a.c. half period; accordingly, the capacitor CLC in the light adjuster 200 is not charged and it is possible to alleviate the flickering of the LED.

Figure 12C:
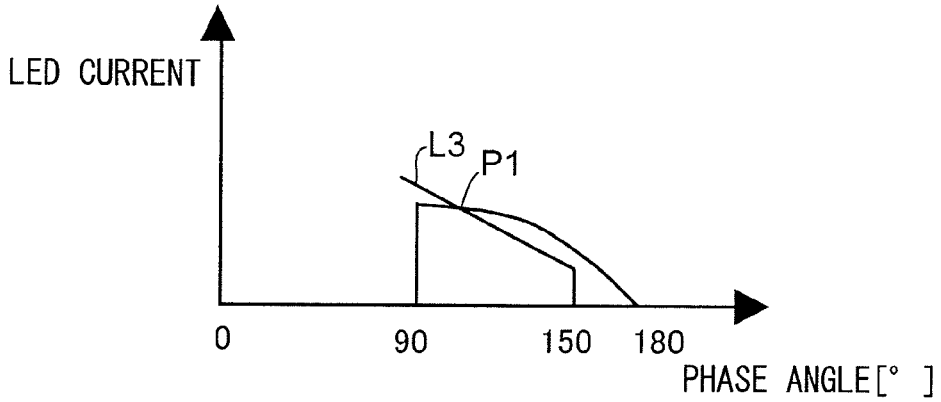
FIG. 12C is a view showing an example of an operation line of an LED current.

Besides, when the switching control circuit 104 detects a predetermined phase angle, the switching device SW1 may be turned off, the LED current may be turned off, and the LED load 400 may be turned off. For example, according to an operation line L3 shown in FIG. 12C, when the predetermined angle of 150° is detected, the LED current is turned off. In this way, after the intersecting at the intersection P1, it is possible to confine the operation line L3 in the arc region S1.

Figure 13:
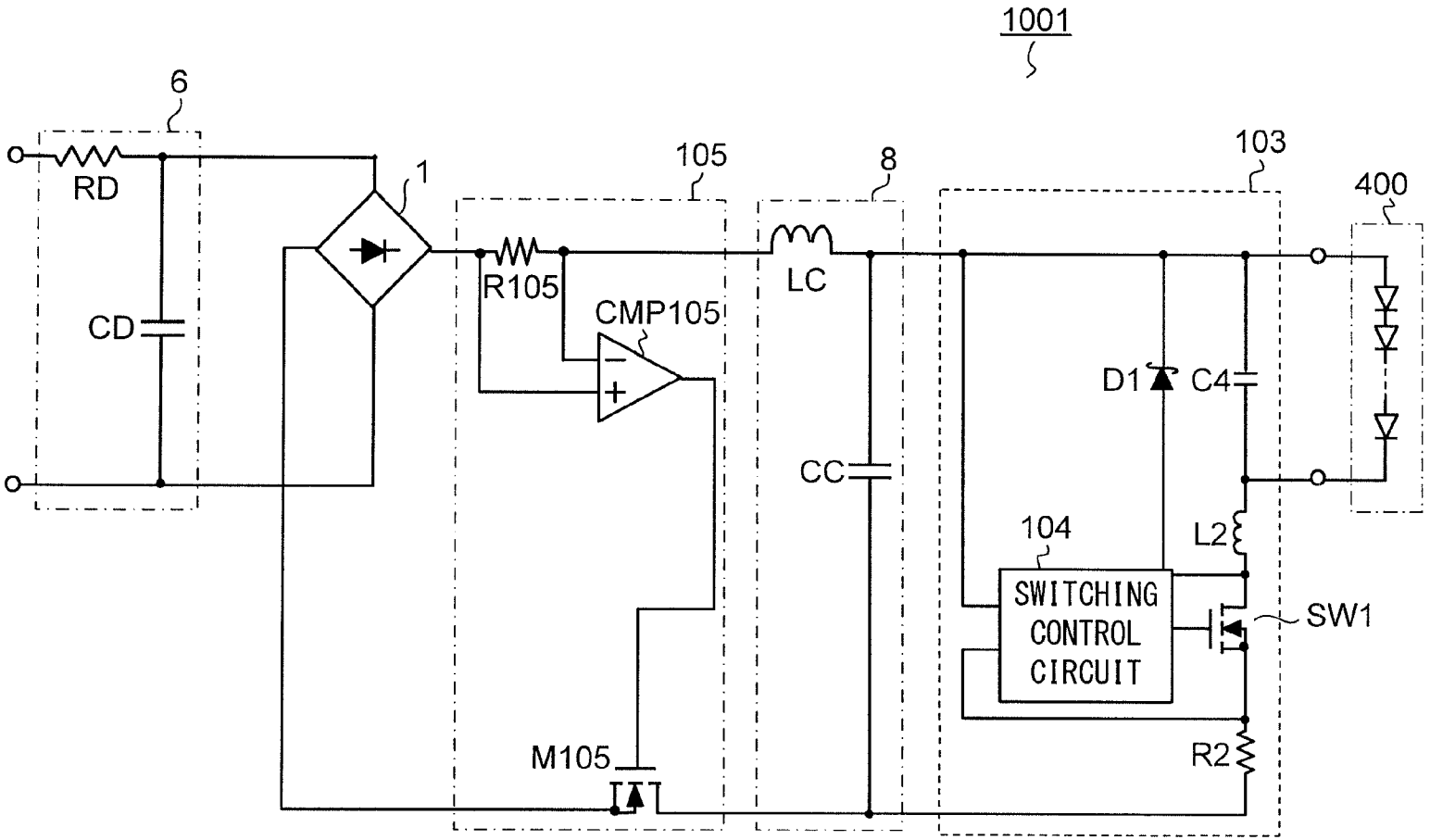
FIG. 13 is a view showing a modification of the LED drive circuit according the fifth embodiment of the present invention.

FIG. 13 shows an LED drive circuit 1001 that is a modification of the LED drive circuit 1000 according to the fifth embodiment of the present invention. The LED drive circuit 1001 has an input current detection portion 105 in a previous stage of the electricity storage portion 8. The input current detection portion 105 has: a resistor R105 connected across the full-wave rectifier 1 and the coil LC; a comparator CMP105 inputs of which are connected with both ends of the resistor R105 and an output of which is connected with a gate of a MOS transistor M105; and the MOS transistor M105.

When the current supply from the light adjuster 200 and the capacitor CC is changed to the current supply from the capacitor CC because of the control by the switching control circuit 104, the input current disappears; accordingly, the comparator CMP105 outputs a Low level signal to the MOS transistor M105. Accordingly, the MOS transistor M105 is turned off and the current supply from the light adjuster 200 is stopped. In this way, thereafter, the capacitor CLC in the light adjuster 200 is prevented from being charged by the current supply from the light adjuster 200 within the identical a.c. half period, and it is possible to alleviate the flickering of the LED.

Figure 14:
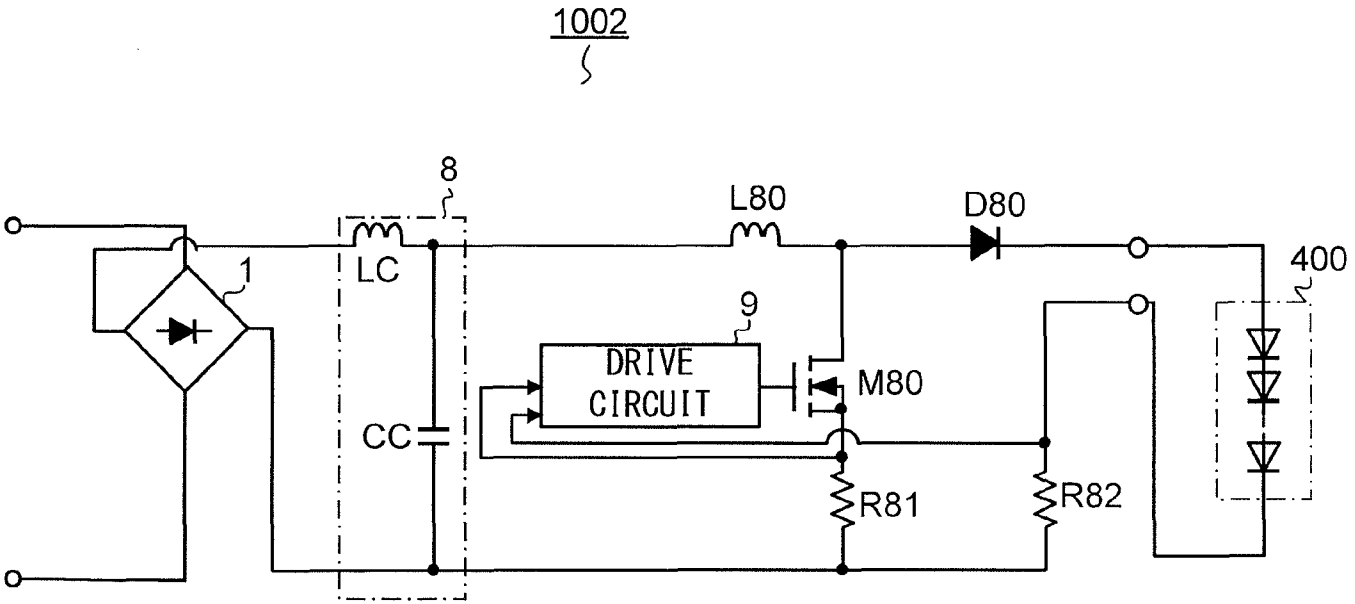
FIG. 14 is a view showing a modification of the LED drive circuit according the third embodiment of the present invention.
Figure 15:
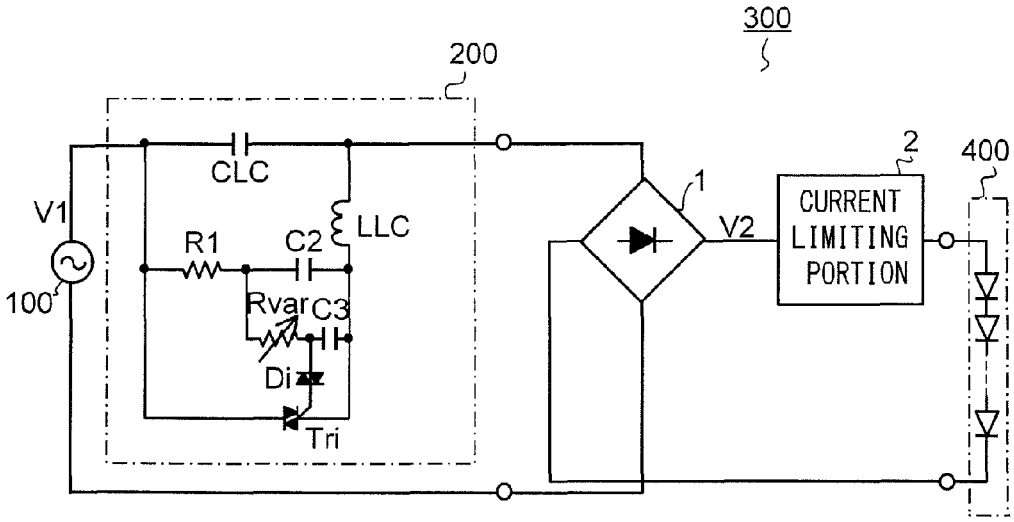
Related Art Fig.15
FIG. 15 is a view showing a conventional example of an LED illumination system.

Besides, for example, if the LED current is controlled as an operation line L4 shown in FIG. 12 by means of an LED drive circuit 1002 shown in FIG. 14 obtained by disposing the electricity storage portion 8 into the LED drive circuit 800 shown in FIG. 9A that is described above, the current is always supplied from the light adjuster 200 and the capacitor CC, and it is possible to prevent the TRIAC Tri from being turned off.

Hereinbefore, the embodiments of the LED drive circuits according to the present invention are described; for example, as an LED illumination light having the LED drive circuit according to the present invention and the LED load, there is an LED light bulb.

What is claimed is:

1. An LED drive circuit that is connectable to an a.c. power supply via a phase control type light adjuster and drives an LED load, comprising:

a discharge portion that consumes energy of a resonance phenomenon generated by a light adjuster capacitance component of the phase control type light adjuster and a light adjuster inductance component of the phase control type light adjuster when a current holding portion of the phase control type light adjuster is turned on.

2. The LED drive circuit according to claim 1, wherein a discharge portion resistance component of the discharge portion and a discharge portion capacitance component of the discharge portion and the light adjuster inductance component meet a formula (1):

$$RD2-4\times LLC/CD\geq 0 \quad (1)$$

where RD: a resistance value (Ω) of the discharge resistance component; LLC: an inductance value (μH) of the light adjuster inductance component; CD: a capacitance value (μF) of the discharge portion capacitance component.

3. The LED drive circuit according to claim 2, wherein the resistance value of the discharge portion resistance component is changeable so as to meet the formula (1) in accordance with the inductance value of the light adjuster inductance component.

4. The LED drive circuit according to claim 1, wherein a discharge portion resistance component of the discharge portion and the light adjuster inductance component meet a formula (2):

$$RD\geq 4.6\times LLC/td \quad (2)$$

where RD: a resistance value (Ω) of the discharge resistance component; LLC: an inductance value (μH) of the light adjuster inductance component; td: a response time (μ) of the current holding portion.

5. The LED drive circuit according to claim 4, wherein the resistance value of the discharge portion resistance component is changeable so as to meet the formula (2) in accordance with the inductance value of the light adjuster inductance component.

6. The LED drive circuit according to claim 1, further comprising:

a changeover control portion that changes on/off of a bypass function of the discharge portion resistance component of the discharge portion in accordance with a magnitude of an input current.

7. The LED drive circuit according to claim 1, further comprising:

an edge detection portion that detects a rising edge of an a.c. voltage controlled in phase, and at a detection time, turns off a bypass function of a discharge portion resistance component of the discharge portion for a predetermined time.

8. The LED drive circuit according to claim 1, further comprising:

a bypass changeover portion that turns on a bypass function of a discharge portion resistance component of the discharge portion in a case where an input current is large or a case of a state where an a.c. voltage controlled in phase is not a rising edge, and turns off the bypass function in a case where the input current is small and the a.c. voltage controlled in phase is the rising edge.

9. An LED drive circuit that is connectable to an a.c. power supply via a phase control type light adjuster and drives an LED load, wherein the phase control type light adjuster has: a current holding portion; a light adjuster capacitance component; and a light adjuster inductance component, and includes an electricity storage portion formed of a series circuit of a capacitor and an inductor which flows a rush current when the current holding portion is turned on.

10. The LED drive circuit according to claim 9, wherein an electricity storage portion inductance component of the electricity storage portion, an electricity storage portion capacitance component of the electricity storage portion, the light adjuster capacitance component and the light adjuster inductance component meet a formula (3):

$$CC\times LC\geq 4\times CLC\times LLC \quad (3)$$

where CC: a capacitance value (F) of the electricity storage portion capacitance component; LC: an inductance value (H) of the electricity storage portion inductance component; CLC: a capacitance value (F) of a capacitance that includes the light adjuster capacitance component; LLC: an inductance value (H) of the light adjuster inductance component.

11. The LED drive circuit according to claim 10, wherein the capacitance value of the electricity storage portion capacitance component is changeable so as to meet the formula (3) in accordance with the capacitance value of the light adjuster capacitance component and/or the inductance value of the light adjuster inductance component.

12. The LED drive circuit according to claim 9, further comprising:

a discharge portion that consumes energy of a resonance phenomenon generated by the light adjuster capacitance component and the light adjuster inductance component when the current holding portion is turned on; and a discharge portion resistance component of the discharge portion, an electricity storage portion inductance component of the electricity storage portion and an electricity storage portion capacitance component of the electricity storage portion meet a formula (4):

$$RD2-4\times LC/CC\geq 0 \quad (4)$$

where RD: a resistance value (Ω) of the discharge resistance component; LC: an inductance value (μH) of the electricity storage portion inductance component; CC: a capacitance value (μF) of the electricity storage portion capacitance component.

13. The LED drive circuit according to claim 12, wherein the resistance value of the discharge portion resistance component is changeable so as to meet the formula (4) in accordance with the capacitance value of the light adjuster capacitance component and/or the inductance value of the light adjuster inductance component.

14. The LED drive circuit according to claim 9, further comprising:

a changeover control portion that changes the capacitance value of the electricity storage portion capacitance component of the electricity storage portion in accordance with a magnitude of an input current.

15. The LED drive circuit according to claim 9, wherein when it is changed from current supply from the phase control type light adjuster and the electricity storage portion to the current supply from the electricity storage portion within an a.c. half period, a current is not supplied from the phase control type light adjuster within an identical a.c. half period.

16. The LED drive circuit according to claim 15, further comprising:

an input current detection portion that stops the current supply from the phase control type light adjuster on detecting that an input current disappears.

17. The LED drive circuit according to claim 15, further comprising:

an current control portion that turns off a current flowing in the LED load on detecting a predetermined phase angle.

18. An LED illumination light, comprising:

an LED drive circuit that is connectable to an a.c. power supply via a phase control type light adjuster and drives an LED load and includes a discharge portion that consumes energy of a resonance phenomenon generated by a light adjuster capacitance component of the phase control type light adjuster and a light adjuster inductance component of the phase control type light adjuster when a current holding portion of the phase control type light adjuster is turned on; and an LED load connected with an output side of the LED drive circuit.

19. An LED illumination light, comprising:

an LED drive circuit that is connectable to an a.c. power supply via a phase control type light adjuster and drives an LED load, in which the phase control type light adjuster has: a current holding portion; a light adjuster capacitance component; and a light adjuster inductance component; and includes an electricity storage portion formed of a series circuit of a capacitor and an inductor which flows a rush current when the current holding portion is turned on; and an LED load connected with an output side of the LED drive circuit.

* * * * *